US007844204B2

(12) United States Patent
Oda

(10) Patent No.: US 7,844,204 B2
(45) Date of Patent: Nov. 30, 2010

(54) LIQUID SEPARATOR, LIQUID MIXTURE SUPPLYING SYSTEM ADOPTING SUCH LIQUID SEPARATOR AND IMAGE FORMING APPARATUS

(75) Inventor: Tomoyuki Oda, Osaka (JP)

(73) Assignee: Kyocera Mita Corporation (JP)

( * ) Notice: Subject to any disclaimer, the term of this patent is extended or adjusted under 35 U.S.C. 154(b) by 468 days.

(21) Appl. No.: 12/035,812

(22) Filed: Feb. 22, 2008

(65) Prior Publication Data

US 2008/0205935 A1 Aug. 28, 2008

(30) Foreign Application Priority Data

Feb. 27, 2007 (JP) ..... 2007-046898
Feb. 28, 2007 (JP) ..... 2007-048450
Feb. 28, 2007 (JP) ..... 2007-049317
Feb. 28, 2007 (JP) ..... 2007-049318

(51) Int. Cl.
*G03G 15/10* (2006.01)

(52) U.S. Cl. ..... 399/249

(58) Field of Classification Search ..... 399/250, 399/237, 241, 239, 249
See application file for complete search history.

(56) References Cited

U.S. PATENT DOCUMENTS 5,987,281 A * 11/1999 Kurotori et al. ..... 399/237
6,731,885 B2 * 5/2004 Anthony et al. ..... 399/35
2007/0077095 A1 * 4/2007 Ueda et al. ..... 399/249
2008/0181671 A1 * 7/2008 Oda ..... 399/241

FOREIGN PATENT DOCUMENTS

JP 2000-89573 3/2000

* cited by examiner

*Primary Examiner*—Quana M Grainger
(74) *Attorney, Agent, or Firm*—Gerald E Hespos; Michael J. Porco

(57) ABSTRACT

A liquid separator is a device for separating and extracting a dispersoid and a dispersion medium from a liquid sample containing the dispersoid and the dispersion medium. The liquid separator is provided with a liquid storage container capable of storing the liquid sample; an electrode roller including a rotary shaft, arranged to touch the liquid sample in the liquid storage container, capable of conveying the liquid sample along the outer circumferential surface thereof and rotatable about the rotary shaft; and a separating member held in contact with the electrode roller for separating the dispersion medium from the liquid sample being conveyed along the outer circumferential surface of the electrode roller. The liquid storage container includes a first container positioned at a specified distance to the electrode roller and a second container detachably attachable to the first container.

20 Claims, 16 Drawing Sheets

LIQUID SEPARATOR, LIQUID MIXTURE SUPPLYING SYSTEM ADOPTING SUCH LIQUID SEPARATOR AND IMAGE FORMING APPARATUS

BACKGROUND OF THE INVENTION

1. Field of the Invention

The present invention relates to a liquid separator for separating and extracting a dispersoid and a dispersion medium from a liquid sample containing them, a liquid mixture supplying system adopting such a liquid separator, and an image forming apparatus.

2. Description of the Related Art

A liquid separator is a device for separating and extracting a dispersoid and a dispersion medium from a liquid sample and, for example, used in an image forming apparatus for performing an image formation using a liquid developer containing toner particles (dispersoid) and a carrier liquid (dispersion medium). In this image forming apparatus, the remaining liquid developer not used for development during an image forming operation is collected, and the toner particles and the carrier liquid are separated using the liquid separator to reutilize the carrier liquid.

In the image forming apparatus of this type, the remaining liquid developer is collected. The collected liquid developer is caused to pass through a continuous foam material sandwiched between electrodes to which different voltages are applied. At this time, the toner particles adhere to the continuous foam material while the carrier liquid passes through the continuous foam material. After the toner particles and the carrier liquid are separated in this way, the carrier liquid is extracted (see Japanese Unexamined Patent Publication No. 2000-89573).

In the liquid separator disclosed in the above patent literature, the liquid developer cannot be separated to extract the carrier liquid if the continuous foam material is clogged with the toner particles. Therefore, maintenance such as the replacement of the continuous foam material needs to be performed, leading to a maintenance cost.

SUMMARY OF THE INVENTION

In order to solve the above problems, an object of the present invention is to save time and labor for maintenance such as the replacement of a continuous foam material and to reduce cost necessary for maintenance.

In order to accomplish the above object, one aspect of the present invention is directed to a liquid separator, comprising a liquid storage container capable of storing the liquid sample; an electrode roller including a rotary shaft, arranged to touch the liquid sample in the liquid storage container, capable of conveying the liquid sample along the outer circumferential surface thereof and rotatable about the rotary shaft; and a separating member held in contact with the electrode roller for separating the dispersion medium from the liquid sample being conveyed along the outer circumferential surface of the electrode roller. The liquid storage container includes a first container positioned at a specified distance to the electrode roller and a second container detachably attachable to the first container.

Another aspect of the present invention is directed to a liquid mixture supplying system, comprising a liquid consuming device for consuming a liquid mixture containing a dispersoid and a dispersion medium; a liquid supplying unit for supplying the liquid mixture to the liquid consuming device; a collection system for collecting the liquid mixture that has been supplied to the liquid consuming device, but has not been consumed by the liquid consuming device; and a liquid separator provided in the collection system for separating and extracting the dispersoid and the dispersion medium from the collected liquid mixture, wherein the liquid separator has the construction of the above liquid separator.

Still another aspect of the present invention is directed to an image forming apparatus, comprising a photoconductive drum for bearing a toner image on the outer circumferential surface thereof; a developing device for supplying a liquid developer containing toner particles and a carrier liquid to the photoconductive drum; a developer producer for producing the liquid developer of the toner particles and the carrier liquid for supply to the developing device by adjusting the mixing ratio of the toner particles and the carrier liquid; a first supply system for supplying a developer having a higher toner density than the developer used in the developing device to the developer producer; a second supply system for supplying the carrier liquid to the developer producer; a third supply system for supplying the liquid developer generated in the developer producer to the developing device via a reserve tank; a collection system for collecting the liquid developer, which has been supplied to the developing device, but has not been consumed by the developing device or the photoconductive drum, and supplying the liquid developer to the developer producer; and a liquid separator provided in the collection system for separating and extracting the toner particles and the carrier liquid from the collected liquid mixture, wherein the liquid separator has the construction of the above liquid separator.

These and other objects, features, aspects and advantages of the present invention will become more apparent upon a reading of the following detailed description with reference to accompanying drawings.

DETAILED DESCRIPTION OF THE PREFERRED EMBODIMENTS

Figure 1:
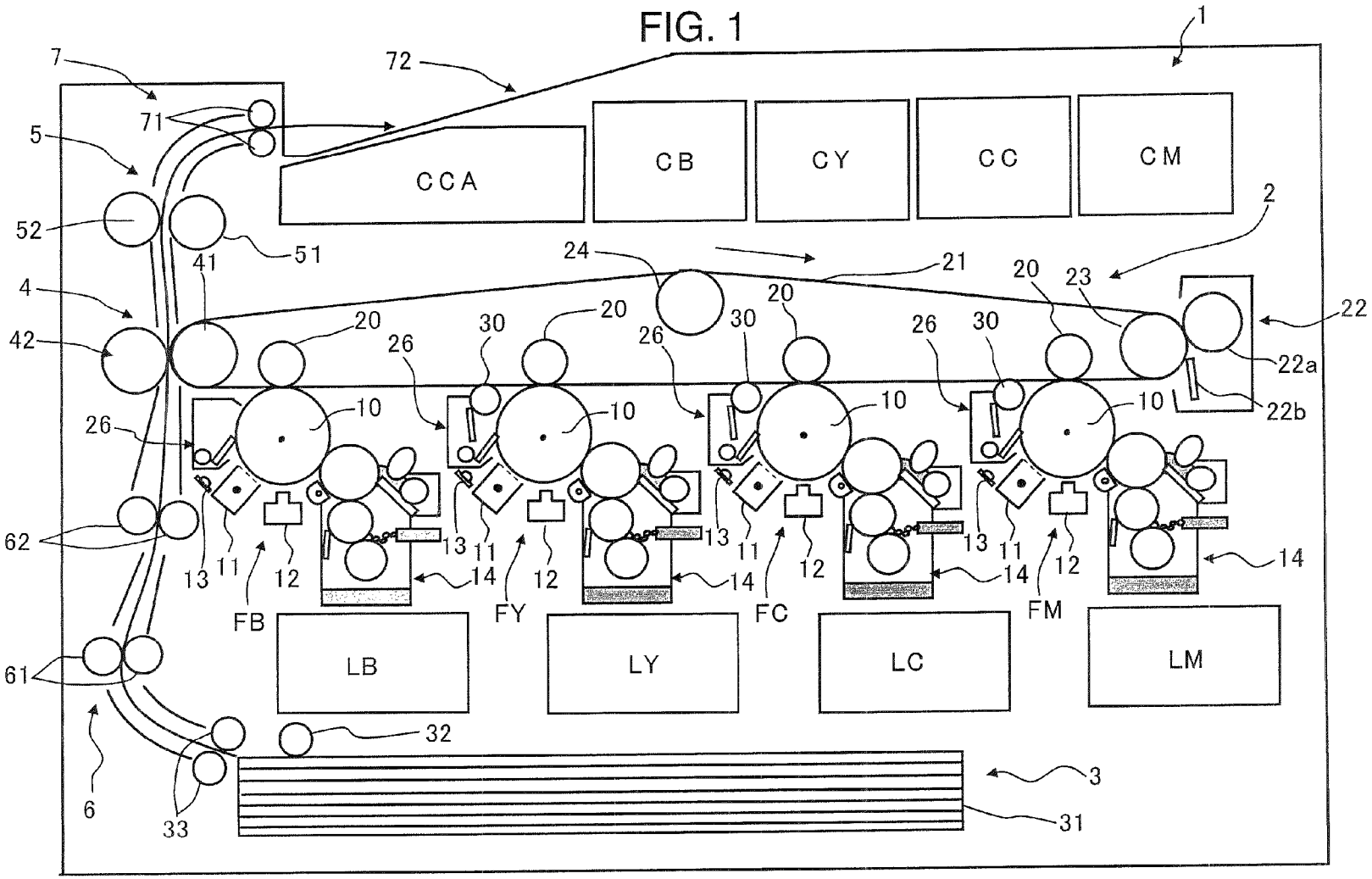
FIG. 1 is a schematic section entirely showing a color printer according to one embodiment of the invention.

Hereinafter, one embodiment of an image forming apparatus according to the present invention is described with reference to the accompanying drawings. It should be noted that the positions, sizes and the like of members are suitably emphasized in the drawings for the convenience of description. Although a color printer is described as an example of the image forming apparatus of the present invention in the following embodiment, the present invention is not limited thereto. It is sufficient for the image forming apparatus according to the present invention to include an image forming assembly, and this image forming apparatus may be a so-called complex machine (MFP: Multi Function Peripheral) having functions as a copier and a facsimile machine or may have only a copy function. The specific constructions of these members, other members and the like described below can be suitably changed.

1. Overall Construction

The schematic construction of a color printer 1 as the image forming apparatus according to one embodiment of the present invention is described with reference to FIGS. 1 and 2. FIG. 1 is a schematic section showing the overall construction of the color printer 1, and FIG. 2 is a section enlargedly showing one image forming assembly.

As shown in FIG. 1, the color printer 1 is provided with a tandem image forming assembly 2 for forming a toner image based on an image data, a sheet accommodating section 3 for accommodating sheets as an example of recording media, a secondary transfer device 4 for transferring a toner image formed in the image forming assembly 2 to a sheet, a fixing device 5 for fixing the transferred toner image to the sheet, a discharging device 7 for discharging the sheet having the image fixed thereto, and a sheet conveying assembly 6 for conveying sheets from the sheet accommodating section 3 to the discharging device 7.

The image forming assembly 2 includes an intermediate transfer belt 21, a cleaner 22 for the intermediate transfer belt 21, and image forming units FM, FC, FY and FB corresponding to the respective colors of magenta (M), cyan (C), yellow (Y), and black (Bk).

Figure 2:
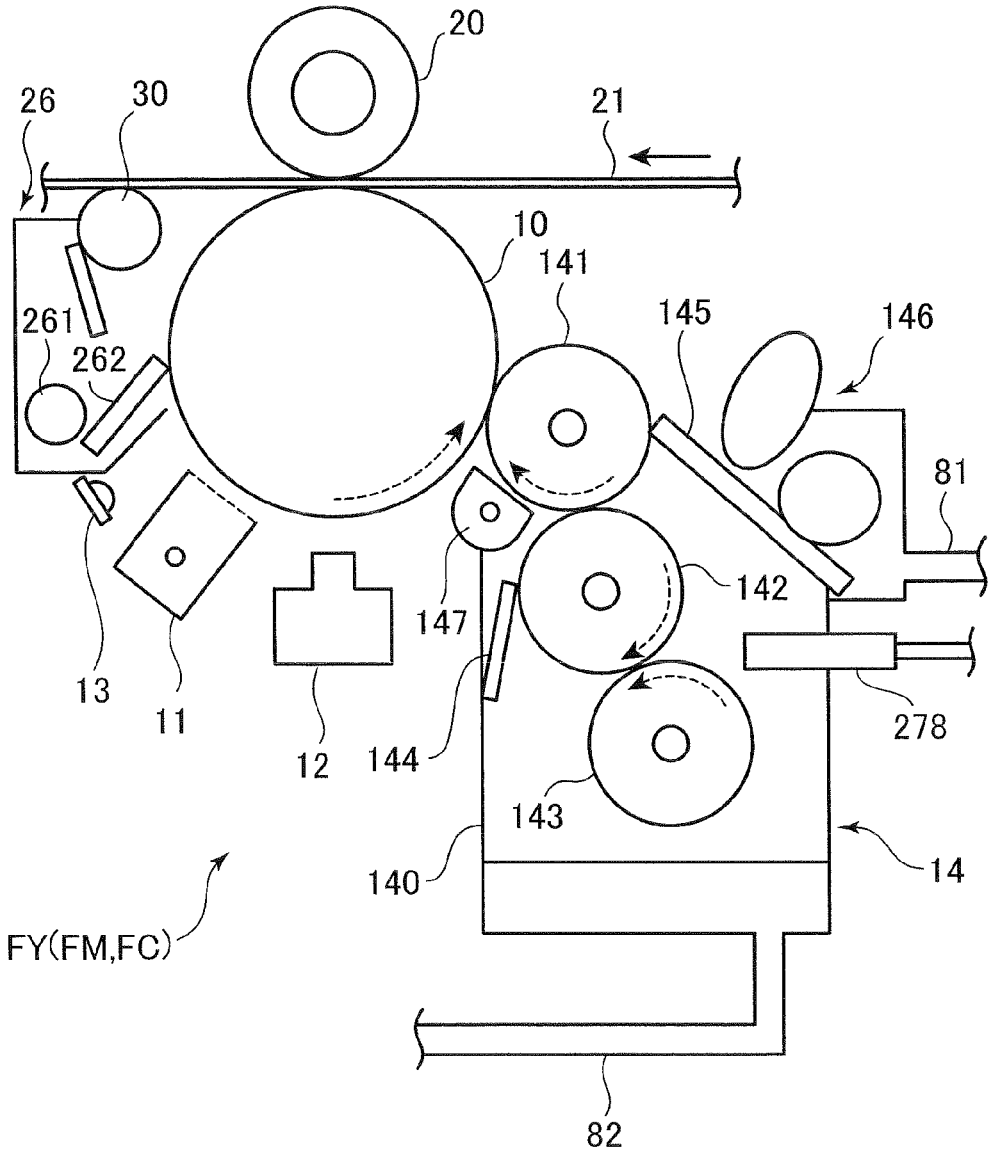
FIG. 2 is a section enlargedly showing one image forming unit.

The intermediate transfer belt 21 is a belt-like member which is electrically conductive, wider than a dimension of maximum usable sheets in a direction normal to a sheet conveying direction and endless, i.e. looped, and is driven to turn clockwise as shown by an arrow in FIGS. 1 and 2. A surface of the intermediate transfer belt 21 facing outward during a turning movement thereof is referred to as a front surface, and the other surface thereof is referred to as a rear surface below.

The intermediate transfer belt 21 is mounted on a drive roller 41 as a constituent element of the second transfer device 4, a driven roller 23 arranged at an end opposite to the drive roller 41 and a tension roller 24 arranged substantially in the middle between the two rollers 41, 23. The drive roller 41 is rotated by the driving of an unillustrated drive motor, whereby the intermediate transfer belt 21 is turned. The driven roller 23 and the tension roller 24 rotate, following the turning movement of the intermediate transfer belt 21. It should be noted that the tension roller 24 is a member for giving a suitable tensile force to the intermediate transfer belt 21 lest the intermediate transfer belt 21 should be slackened.

The four image forming units FM, FC, FY and FB are arranged side by side near the intermediate transfer belt 21 between the cleaner 22 for the intermediate transfer belt 21 and the secondary transfer device 4. Here is shown an example in which the image forming units FM, FC, FY and FB are successively arranged from an upstream side in a turning direction of the intermediate transfer belt 21. Although the arrangement order of the respective image forming units FM, FC, FY and FB is not limited to the above, this arrangement is preferable in view of the influence of the mixing of the respective colors on completed images.

Each of the image forming units FM, FC, FY and FB includes a photoconductive drum 10, a charger 11, an exposure device 12, a developing device 14, a primary transfer roller 20, a cleaning device 26, a charge neutralizer 13 and a carrier liquid removing roller 30. Out of the image forming units, the image forming unit FB located closest to the secondary transfer device 4 includes no carrier liquid removing roller 30, but is identical in the other construction.

Liquid developer circulators LM, LC, LY and LB and toner tanks CM, CC, CY and CB are provided in correspondence with the respective image forming units FM, FC, FY and FB. Further, a carrier tank CCA shared by the respective image forming units FM, FC, FY and FB is provided. By providing these members, liquid developers of the respective colors are supplied and collected (pipes and the like connecting these members are not shown). The liquid developer circulators LM, LC, LY and LB are described in detail later.

The photoconductive drum 10 is a cylindrical member and can bear a toner image including charged toner particles (positively charged in this embodiment) on the outer circumferential surface thereof. The photoconductive drum 10 is a member rotatable counterclockwise in FIG. 2.

The charger 11 is a device capable of uniformly charging the outer circumferential surface of the photoconductive drum 10.

The exposure device 12 includes a light source such as an LED and irradiates the uniformly charged outer circumferential surface of the photoconductive drum 10 with light in accordance with an image data inputted from an external apparatus. Thus, an electrostatic latent image is formed on the outer circumferential surface of the photoconductive drum 10.

The developing device 14 (liquid consuming device) attaches toner particles to the electrostatic latent image by retaining the liquid developer (liquid mixture) containing toner particles (dispersoid) and liquid carrier (dispersion medium) to face the electrostatic latent image on the outer circumferential surface of the photoconductive drum 10. Thus, the electrostatic latent image is developed into a toner image.

With reference to FIG. 2, the developing device 14 includes a developer container 140, a development roller 141, a supply roller 142, a support roller 143, a supply roller blade 144, a development roller cleaning blade 145, a developer collector 146 and a development roller charger 147.

The developer container 140 is a container for receiving the supply of a liquid developer comprised of toner particles and liquid carrier inside. As described later, this liquid developer is supplied into the developer container 140 via a supply nozzle 278 with the ratio of the toner particles and the carrier liquid regulated beforehand. The liquid developer is supplied toward the support roller 143 near a nip portion between the supply roller 142 and the support roller 143, and a surplus is caused to drop below the support roller 143 and stored at the bottom of the developer container 140. The stored liquid developer is collected by the liquid developer circulator via a pipe 82 (see FIG. 3).

The support roller 143 is arranged substantially in the center of the developer container 140 and so held in contact with the supply roller 142 as to support the supply roller 142 from below, thereby forming the nip portion. The supply roller 142 is arranged not right above the support roller 143, but obliquely above the support roller 143 in a direction away from the supply nozzle 278, and has grooves for retaining the liquid developer formed in the outer circumferential surface thereof. As shown by dotted line arrows in FIG. 2, the support roller 143 rotates counterclockwise and the supply roller 142 rotates clockwise.

The liquid developer supplied from the supply nozzle 278 is temporarily accumulated at a side upstream of the nip portion in the rotating direction, and is carried upward while being retained in the above grooves of the supply roller 142 as the two rollers 142, 143 rotate. The supply roller blade 144 is pressed into contact with the outer circumferential surface of the supply roller 142 to restrict the volume of the liquid developer retained by the supply roller 142 to a specified volume. The surplus liquid developer scraped off by the supply roller blade 144 is received at the bottom of the developer container 140.

The development roller 141 is so arranged in an upper opening of the developer container 140 as to touch the supply roller 142. The development roller 141 is rotated in the same direction as the supply roller 142 (in the nip portion where the development roller 141 and the supply roller 142 are in contact, the outer circumferential surface of the development roller 141 moves in a direction opposite to the one in which the outer circumferential surface of the supply roller 142 moves), whereby the liquid developer retained on the outer circumferential surface of the supply roller 142 is transferred to the outer circumferential surface of the development roller 141. Since the layer thickness of the liquid developer on the supply roller 142 is restricted to a specified value, the thickness of the liquid developer layer formed on the outer circumferential surface of the development roller 141 is also kept at a specified value.

The development roller charger 147 fulfills a function of causing the toner particles in the developer layer borne on the development roller 141 to transfer toward the outer circumferential surface side of the development roller 141 by giving a charging potential having the same polarity as the charging polarity of the toner particles, thereby improving development efficiency. The development roller charger 147 is so provided as to face the outer circumferential surface of the development roller 141 at a side downstream of a contact portion of the development roller 141 with the supply roller 142 and upstream of a contact portion of the development roller 141 with the photoconductive drum 10 in the rotating direction.

The development roller 141 is in contact with the photoconductive drum 10. The toner particles are supplied corresponding to a potential difference between the potential of an electrostatic latent image on the outer circumferential surface of the photoconductive drum 10 and a development bias applied to the development roller 141, and thereby a toner image corresponding to a given image data is formed on the outer circumferential surface of the photoconductive drum 10 (developing operation).

The development roller cleaning blade 145 is so arranged as to touch the development roller 141 at a side downstream of the contact portion of the development roller 141 with the photoconductive drum 10 and upstream of the contact portion of the development roller 141 with the supply roller 142 in the rotating direction and removes the liquid developer on the outer circumferential surface of the development roller 141 having finished the developing operation for the photoconductive drum 10.

The developer collector 146 collects the liquid developer removed by the development roller cleaning blade 145 and feeds the collected liquid developer to a pipe 81 of the corresponding liquid developer circulator. Although the liquid developer flows down along the outer circumferential surface of the development roller cleaning blade 145, a feed roller for assisting the feed of the liquid developer is provided in the developer collector 146 since the liquid developer has a high viscosity.

The primary transfer roller 20 is arranged to face the photoconductive drum 10 at the rear side of the intermediate transfer belt 21. A voltage having a polarity (negative in this embodiment) opposite to the charging polarity of the toner particles in the toner image is applied to the primary transfer roller 20 from an unillustrated power supply. In other words, the primary transfer roller 20 applies a voltage having a polarity opposite to that of the toner particles to the intermediate transfer belt 21 at a contact position with the intermediate transfer belt 21. Since the intermediate transfer belt 21 is electrically conductive, the toner particles are attracted to the front side of the intermediate transfer belt 21 and its periphery by this applied voltage.

The cleaning device 26 is a device for cleaning the residual liquid developer left without being transferred from the photoconductive drum 10 to the intermediate transfer belt 21, and includes a residual developer conveying screw 261 and a cleaning blade 262. The residual developer conveying screw 261 is a member for conveying the residual developer scraped off by the cleaning blade 262 and contained in the cleaning device 26 to the outside of the cleaning device 26, and is arranged in the cleaning device 26.

The cleaning blade 262 is a plate-like member for scraping off the liquid developer residual on the outer circumferential surface of the photoconductive drum 10 and extends in a direction of the axis of rotation of the photoconductive drum 10. The cleaning blade 262 has an end thereof held in sliding contact with the outer circumferential surface of the photoconductive drum 10 to scrape off the liquid developer residual on the photoconductive drum 10 as the photoconductive drum 10 rotates.

The charge neutralizer 13 includes a light source for charge neutralization and neutralizes the outer circumferential surface of the photoconductive drum 10 by light from the light source after the liquid developer on the outer circumferential surface of the photoconductive drum 10 is removed by the cleaning blade 262 in preparation for a next image forming operation.

The carrier liquid removing roller 30 is a substantially cylindrical member rotatable in the same direction as the photoconductive drum 10 about an axis of rotation parallel to that of the photoconductive drum 10. The carrier liquid removing roller 30 is arranged at a position closer to the secondary transfer device 4 than the contact position of the photoconductive drum 10 and the intermediate transfer belt 21, and removes the carrier liquid from the outer circumferential surface of the intermediate transfer belt 21.

Referring back to FIG. 1, the sheet accommodating section 3 is for accommodating sheets to which toner images are to be fixed, and arranged at the bottom in the interior of the color printer 1. The sheet accommodating section 3 includes a sheet cassette 31 for accommodating sheets, a feed roller 32 and a pair of sheet separation rollers 33.

The secondary transfer device 4 is for transferring a toner image formed on the intermediate transfer belt 21 to the sheet and includes a support roller 41 for supporting the intermediate transfer belt 21 and a secondary transfer roller 42 arranged to face the support roller 41.

The fixing device 5 is for fixing a toner image to a sheet and arranged above the secondary transfer device 4. The fixing device 5 includes a heating roller 51 and a pressure roller 52 arranged to face the heating roller 51.

The sheet conveying assembly 6 includes a pair of conveyance rollers 61 and a pair of registration rollers 62 for conveying a sheet from the sheet accommodating section 3 to the secondary transfer device 4, the fixing device 5 and the discharging device 7.

The discharging device 7 is for discharging a sheet having a transferred toner image fixed thereto in the fixing device 5, and includes a pair of discharge rollers 71 and a discharge tray 72 provided on the upper surface of the color printer 1.

The cleaner 22 for the intermediate transfer belt 21 includes a cleaning roller 22*a* and a cleaning blade 22*b*.

2. Liquid Developer Circulator

Figure 3:
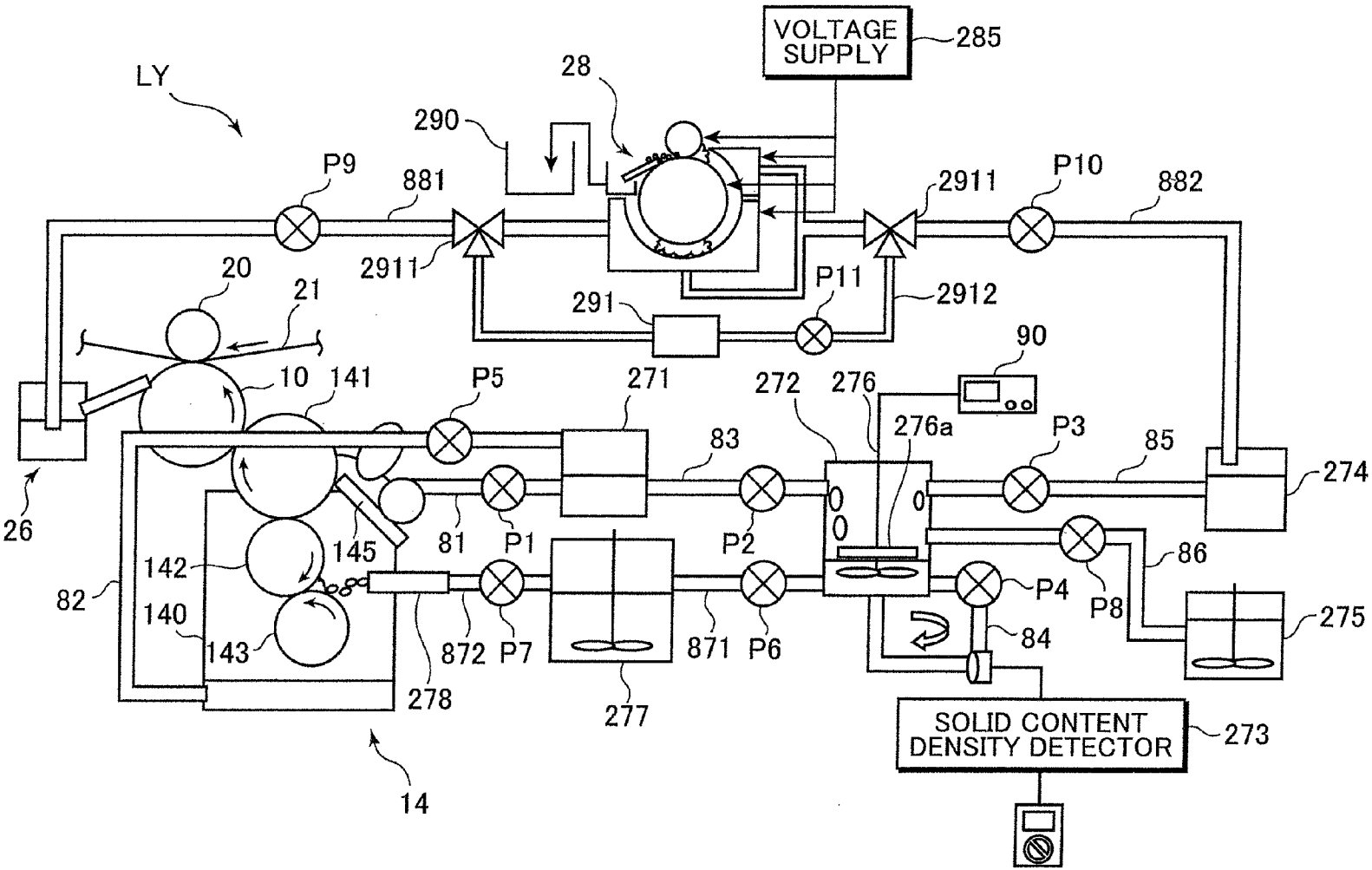
FIG. 3 is a construction diagram of the developer circulator.

FIG. 3 schematically and entirely shows one liquid developer circulator LY. The other liquid developer circulators LM, LC and LB have the same construction. This liquid developer circulator LY is a device for circulating and reutilizing the residual developer (mixture of the toner particles and the carrier liquid) that has been supplied to the developing device 14, but has not been consumed by developing an electrostatic latent image formed on the outer circumferential surface of the photoconductive drum and stored at the bottom of the developer container 140.

The liquid developer circulator LY includes a residual developer tank 271, a developer adjusting device 272, a solid content density detector 273, a carrier tank 274, a toner tank 275, a liquid level detector 276, a developer reserve tank 277, a liquid developer supplier (supply nozzle) 278, a liquid developer separator 28 (liquid separator as claimed), a plurality of pumps P1 to P11 and a controller 90.

The residual developer tank 271 is a tank connected to the developing device 14 via first and second pipes 81, 82 and capable of containing the liquid developer collected from the developing device 14. The first and fifth pumps P1, P5 are respectively mounted at intermediate positions of the first and second pipes 81, 82.

The liquid developer scraped off from the outer circumferential surface of the development roller 141 by the development roller cleaning blade 145 after the toner particles are supplied to the photoconductive drum 10 is transferred to the residual developer tank 271 via the first pipe 81 by driving the first pump P1. Further, the liquid developer collected into the developer container 140 without being supplied from the supply roller 142 to the development roller 141 in the developer container 140 is transferred to the residual developer tank 271 via the second pipe 82 by driving the fifth pump P5.

The developer adjusting device 272 adjusts the toner density of the residual developer within a proper range by adding a developer having a higher toner density than the developer used in the developing device 14 or the carrier liquid to the residual developer. The liquid developer having the toner density adjusted is supplied to the developing device 14. The developer adjusting device 272 is connected to the residual developer tank 271 via a third pipe 83, and the second pump P2 is mounted in this third pipe 83. The liquid developer in the residual developer tank 271 is fed to the developer adjusting device 272 via the third pipe 83 by driving the second pump P2 (above, collection system).

The solid content density detector 273 is a device for detecting the density of the toner particles in the liquid developer in the developer adjusting device 272. The solid content density detector 273 is connected with a looped fourth pipe 84 connected with the developer adjusting device 272. The fourth pump P4 is mounted in this looped fourth pipe 84. The liquid developer in the developer adjusting device 272 is introduced to the solid content density detector 273 from the entrance end of the fourth pipe 84 by driving the fourth pump P4 and returned to the developer adjusting device 272 from the exit end of the fourth pipe 84.

The carrier tank 274 is a tank containing the carrier liquid. If the solid content density detector 273 judges that the toner density in the developer adjusting device 272 is above the proper range, the carrier liquid is supplied from the carrier tank 274 into the developer adjusting device 272 to decrease the toner density of the liquid developer in the developer adjusting device 272. The carrier tank 274 and the developer adjusting device 272 are connected via a fifth pipe 85, and the carrier liquid is supplied by driving the third pump P3 mounted at an intermediate position of the fifth pipe 85 (second supply system). It should be noted that the carrier tank 274 is supplied the carrier liquid from the carrier tank CCA via an unillustrated pipe.

The toner tank 275 is a tank containing a liquid developer having a higher toner density than the developer used in the developing device 14. If the solid content density detector 273 judges that the toner density in the developer adjusting device 272 is below the proper range, the liquid developer having a higher toner density is supplied from the toner tank 275 into the developer adjusting device 272 to increase the toner density of the liquid developer in the developer adjusting device 272. The toner tank 275 and the developer adjusting device 272 are connected via a sixth pipe 86, and the liquid developer is supplied by driving the eighth pump P8 mounted at an intermediate position of the sixth pipe 86 (first supply system). It should be noted that the toner tank 275 is supplied the liquid developer having a higher toner density from the toner tank corresponding each color via an unillustrated pipe.

The liquid level detector 276 is a device for detecting the volume of the liquid developer in the developer adjusting device 272 and is arranged in the developer adjusting device 272. The liquid level detector 276 includes a liquid level detecting member 276*a* disposed to come into contact with the liquid developer when the liquid level of the liquid developer in the developer adjusting device 272 reaches a specified height position or higher, and a motor (not shown) for driving the liquid level detecting member 276*a*. The liquid level detecting member 276*a* detects the volume of the liquid developer based on a load change of the motor resulting from the contact with the liquid surface of the liquid developer.

The developer reserve tank 277 is a tank for storing the liquid developer to be supplied to the developing device 14. The developer reserve tank 277 is connected to the developer adjusting device 272 via a seventh pipe 871, and receives the supply of the liquid developer from the developer adjusting device 272 by driving the sixth pump P6 provided at an intermediate position of the seventh pipe 871.

The supply nozzle 278 is a member for supplying the liquid developer stored in the developer reserve tank 277 to the developing device 14 (developer container 140). The supply nozzle 278 and the developer reserve tank 277 are connected via an eighth pipe 872, and the liquid developer is supplied by driving the seventh pump P7 mounted in the eighth pipe 872 (above, third supply system).

Although not shown, liquid level detectors for detecting liquid levels in the residual developer tank 271, the carrier tank 274, the toner tank 275 and the residual developer reserve tank 277 are provided at suitable positions of these tanks.

The liquid developer separator 28 is a device for separating the toner particles and the carrier liquid from the residual developer collected by the cleaning device 26 and separately extracting the toner particles and the carrier liquid. The cleaning device 26 and the liquid developer separator 28 are connected via a ninth pipe 881 having the ninth pump P9 mounted therein. The residual developer in the cleaning device 26 is fed to the liquid developer separator 28 by driving the ninth pump P9. Further, the liquid developer separator 28 and the carrier tank 274 are connected via a tenth pipe 882 having the tenth pump P10 mounted therein. The carrier liquid extracted in the liquid developer separator 28 is fed to the carrier tank 274 by driving the tenth pump P10.

Figure 4:
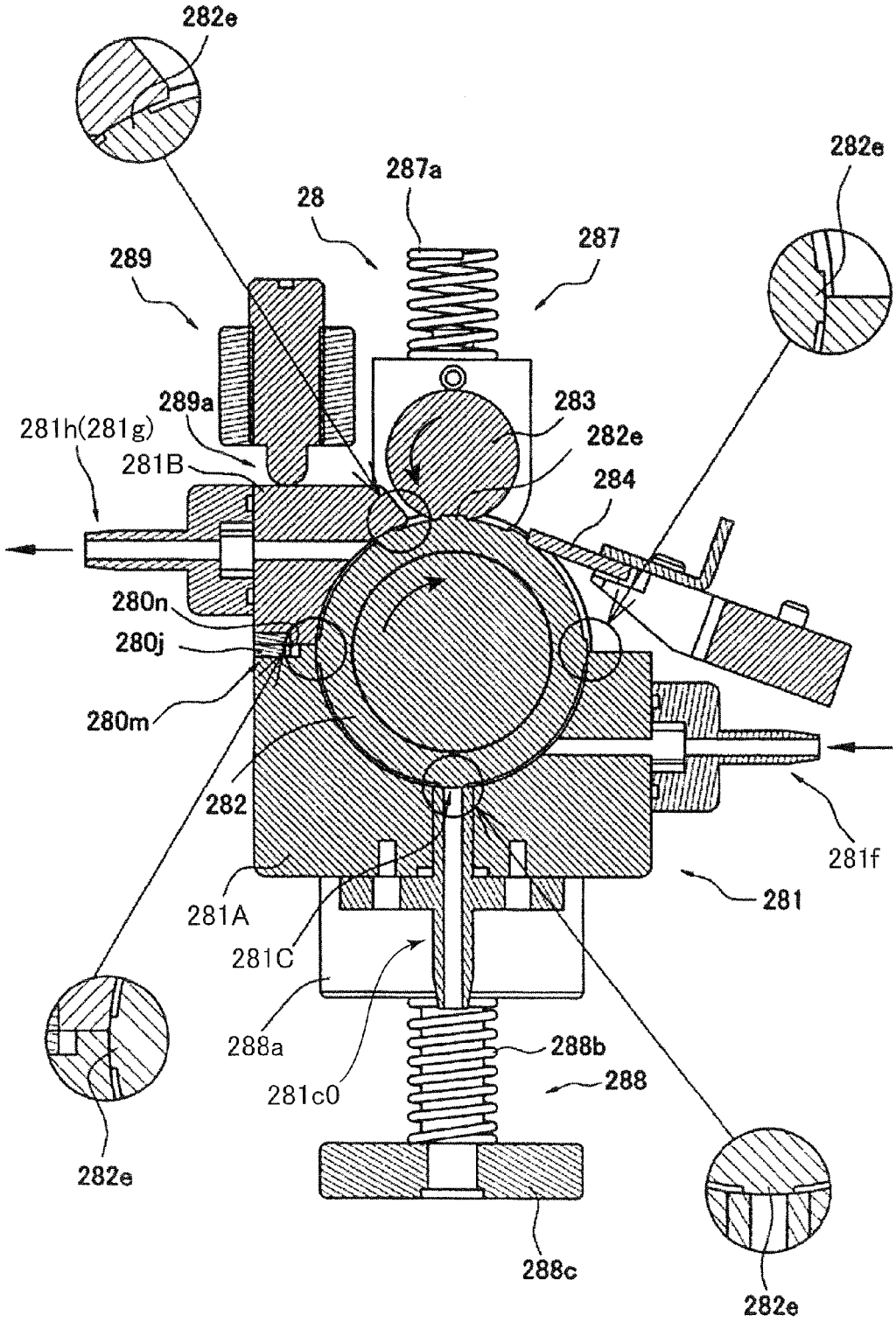
FIG. 4 is a section entirely showing a liquid developer separator.
Figure 5:
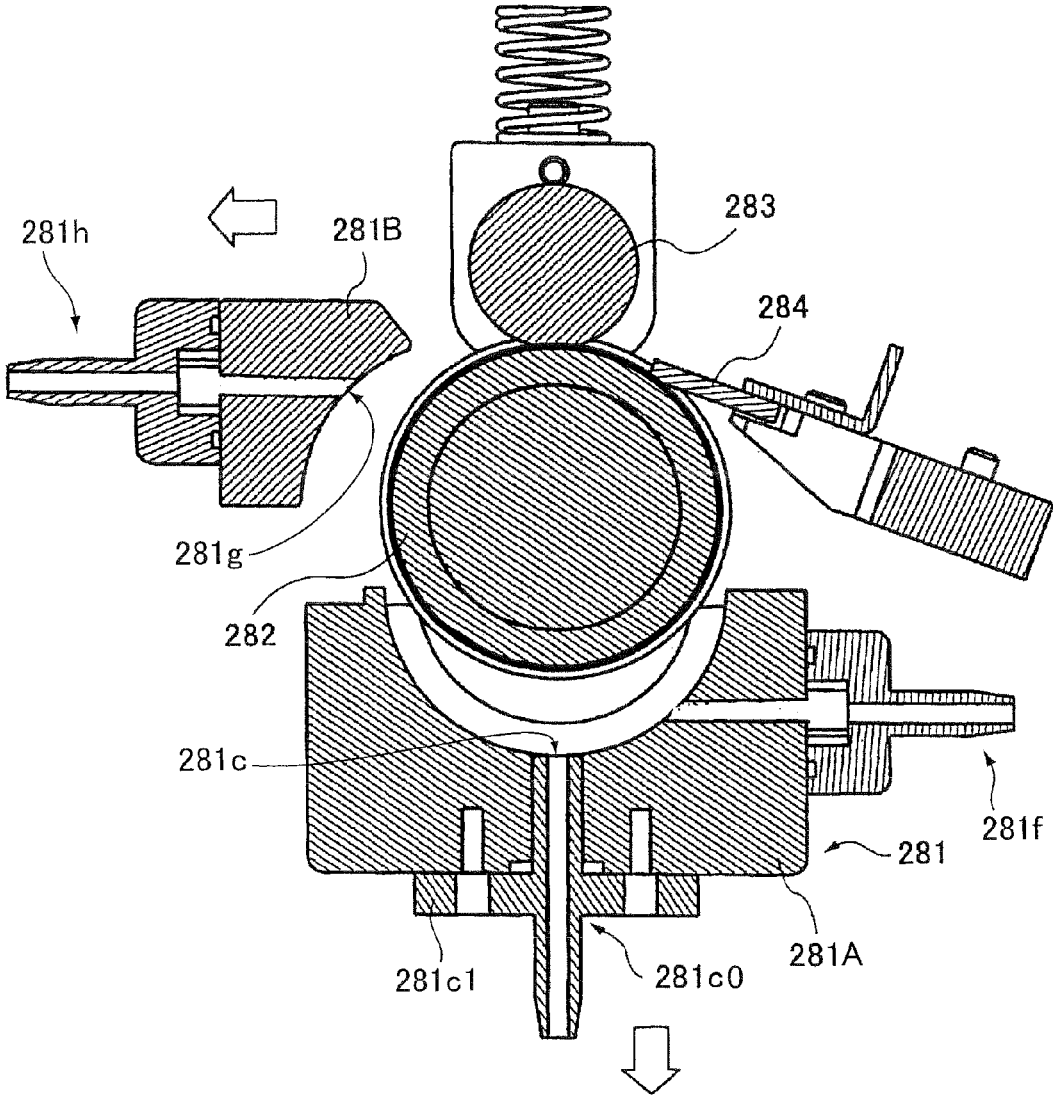
FIG. 5 is a section entirely showing the liquid developer separator in a disassembled state.

The liquid developer separator 28 is described in detail below. FIG. 4 is a section showing the entire liquid developer separator 28, and FIG. 5 is a section entirely showing the liquid developer separator 28 in a disassembled state. As shown in FIGS. 4 and 5, the liquid developer separator 28 includes a liquid storage container 281, an electrode roller 282, a separation roller 283 (separating member), a blade member 284 (collecting member), a voltage supply 285 (see FIG. 3), liquid motion preventing portions 286 (see FIG. 15), biasing mechanisms 287 (see FIG. 4), a first container biasing mechanism 288, a second container biasing mechanism 289, a toner collection container 290 and a toner density measuring device 291 (see FIG. 3).

The liquid storage container 281 is a container capable of storing the liquid developer and is made of an electrically conductive material. The liquid storage container 281 has a first container 281A and a second container 281B, to each of which a specified voltage is applied from the voltage supply 285. The second container 281B is detachably attachable to the first container 281A, and a sealing member 280*j* is provided in a portion where the both containers are joined.

Figure 6:
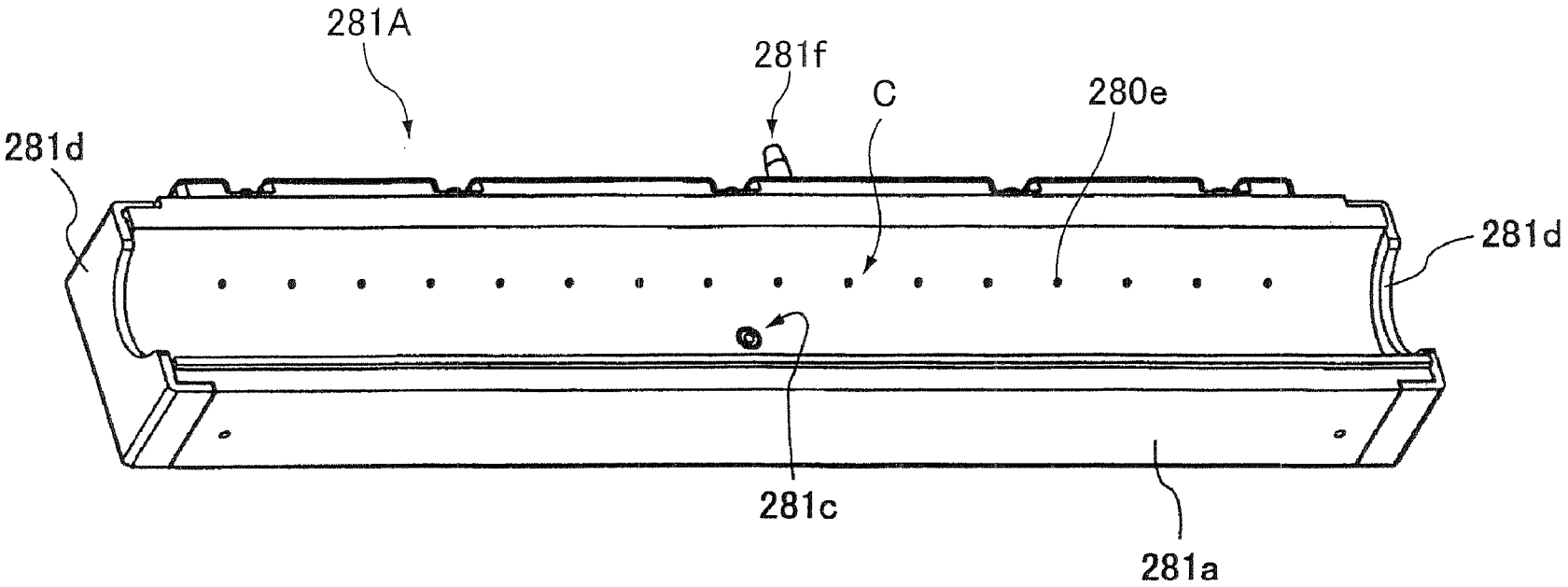
FIG. 6 is an entire perspective view of a first container.
Figure 7:
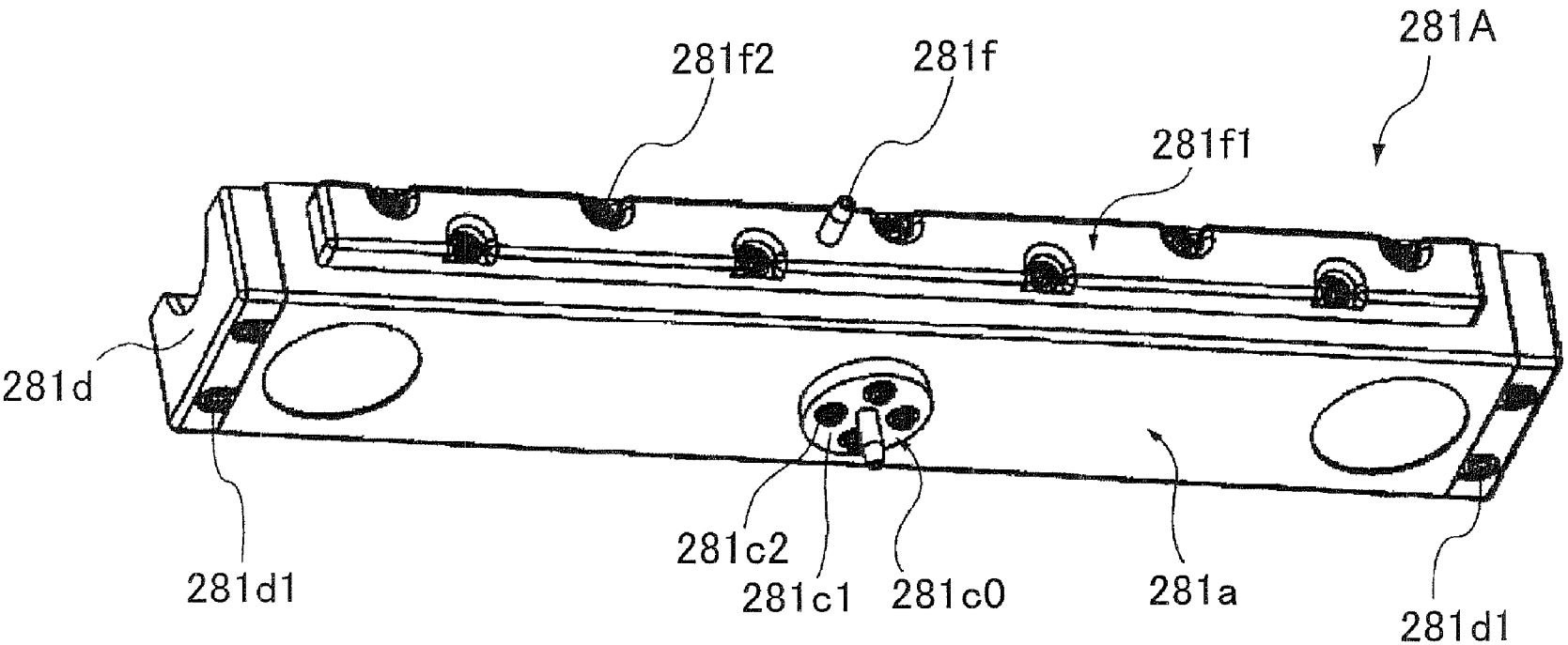
FIG. 7 is an entire perspective view of the first container when viewed from below.
Figure 8:
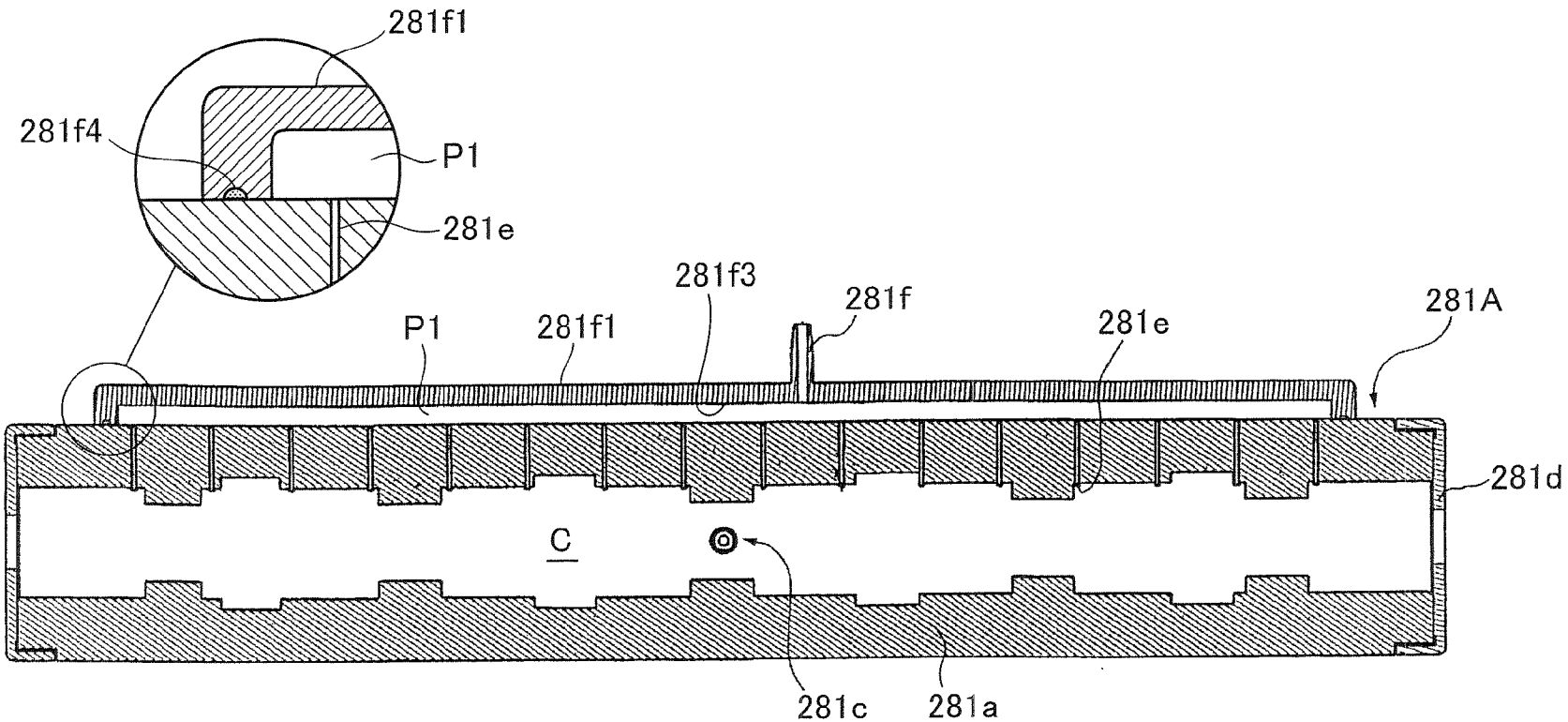
FIG. 8 is a section of the first container.

FIG. 6 is an entire perspective view of the first container 281A, FIG. 7 is an entire perspective view of the first container 281A when viewed from below, and FIG. 8 is a section of the first container 281A. The first container 281A is a member rectangular in top view and having a semicylindrical cavity C capable of accommodating the lower half of the outer circumferential surface of the electrode roller 282. The spacing between the surface of this cavity C and the outer circumferential surface of the electrode roller 282 is kept at a specified distance (e.g. 0.5 mm).

The first container 281A includes a container main body 281*a* formed with the cavity C, a supply port 281*f* formed at such a position of a lateral side of the container main body 281*a* as to face a lateral bottom part of the electrode roller 282, a plurality of injection openings 280*e* perforated in the container main body 281*a* in a row along the longitudinal direction of the cavity C, a first discharge port 281*c* formed substantially in the longitudinal center of the container main body 281*a* and right below the electrode roller 282, and a pair of tray covers 281*d* attached to the opposite longitudinal ends of the container main body 281*a*.

As shown in FIG. 7, the supply port 281*f* is for receiving the supply of the liquid developer into the liquid storage container 281 and is connected with an end of the ninth pipe 881 (see FIG. 3). The injection openings 280*e* are through holes with a very small diameter, which penetrate from the inner circumferential wall of the cavity C to the outer surface of the container main body 281*a* for injecting the liquid developer toward the electrode roller 282 in the cavity C. The residual developer collected by the cleaning device 26 is introduced into the cavity C via the supply port 281*f* and the injection openings 280*e*.

The supply port 281*f* is provided on a first cover member 281*f*1 mounted on a side wall of the container main body 281*a* by means of screws 281*f*2. As shown in FIG. 8, the first cover member 281*f*1 has a shallow recess 281*f*3 to form a first liquid conveyance passage P1 communicating with the respective injection openings 280*e*. The supply port 281*f* penetrates the bottom surface of this recess 281*f*3. A side of the first cover member 281*f*1 where the recess 281*f*3 is formed is held in contact with the side wall of the container main body 281*a*, and a sealing member 281*f*4 is provided at the opening edge of the recess 281*f*3 to prevent liquid leakage as enlargedly shown in a circle of FIG. 8. By mounting such a first cover member 281*f*1, the supply port 281*f*, the first liquid conveyance passage P1 and the plurality of injection openings 280*e* communicate to form a manifold supply passage for the liquid developer.

The cross-sectional shape of the cavity C is made uneven in FIG. 8 because the screws 281*f*2 for fixing the cover member 281*f*1 are mounted in a zigzag manner (see FIG. 7) and the section of FIG. 8 is shown to avoid parts of the cover C where the screws 281*f*2 are mounted.

The first discharge port 281*c* is for discharging the separated and extracted carrier liquid to the outside of the first container 281A. The first discharge port 281*c* is a hole formed at the bottommost position of the cavity C and penetrating directly downward from the inner circumferential wall of the cavity C to the outer surface of the container main body 281*a*.

One end of a tubular member 281*c*0 is inserted into the first discharge port 281*c* (see FIGS. 5 and 7). The tubular member 281*c*0 is a cylindrical member extending in vertical direction and has a flange plate 281*c*1 substantially in the longitudinal center. This flange plate 281*c*1 is held in contact with the outer surface of the container main body 281*a* and fixed by bolts 281*c*2, whereby the tubular member 281*c*0 is mounted on the container main body 281*a*. The end of the tubular member 281*c*0 toward the cavity C is accurately positioned so as not to form any step on the inner wall of the cavity C.

Each tray cover 281*d* has an arcuate recess opposed at a very short distance to unillustrated bearing members for rotatably holding a rotary shaft 282*a* of the electrode roller 282 at the corresponding longitudinal end of the electrode roller 282. The tray covers 281*d* are fixed to the container main body 281*a* by screws 281*d*1 to prevent the liquid developer residual in the first container 281A from leaking to the outside in the case of detaching the first container 281A from the electrode roller 282.

Figure 9:
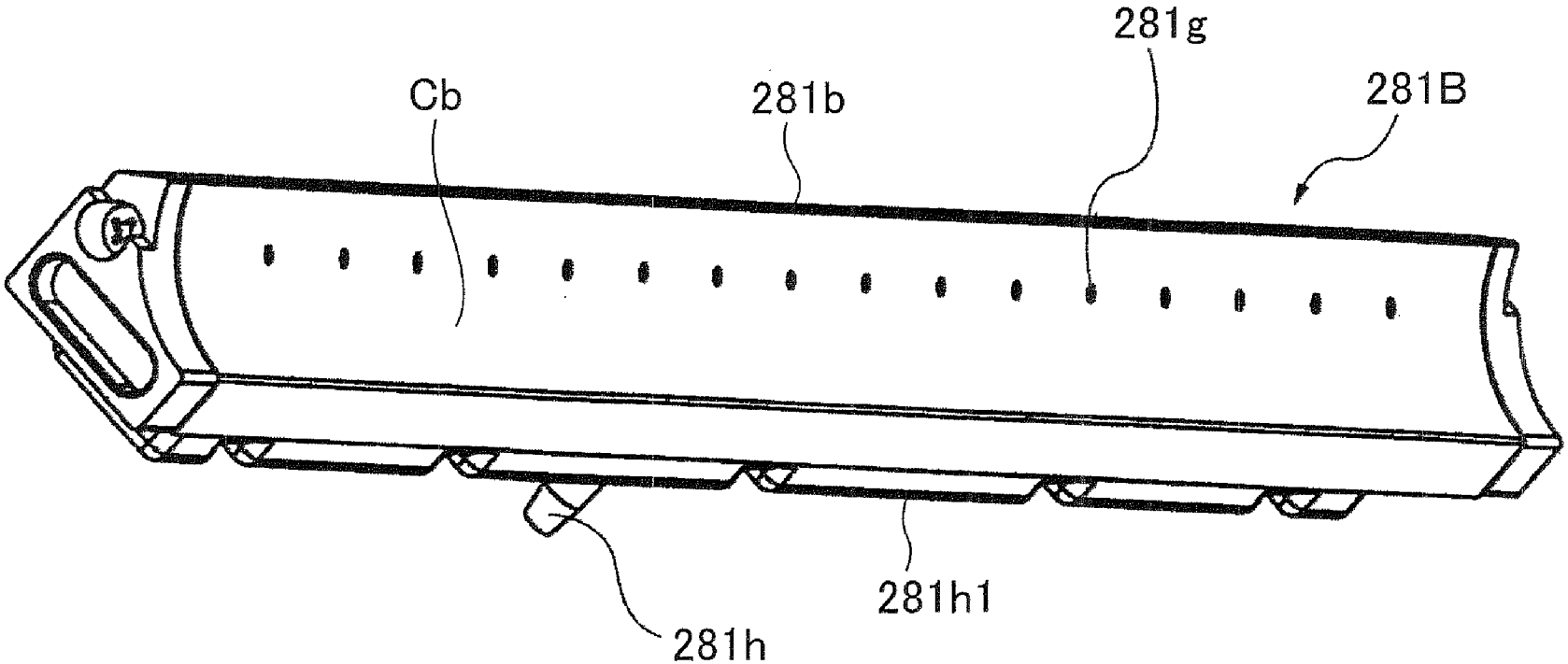
FIG. 9 is an entire perspective view of a second container.
Figure 10:
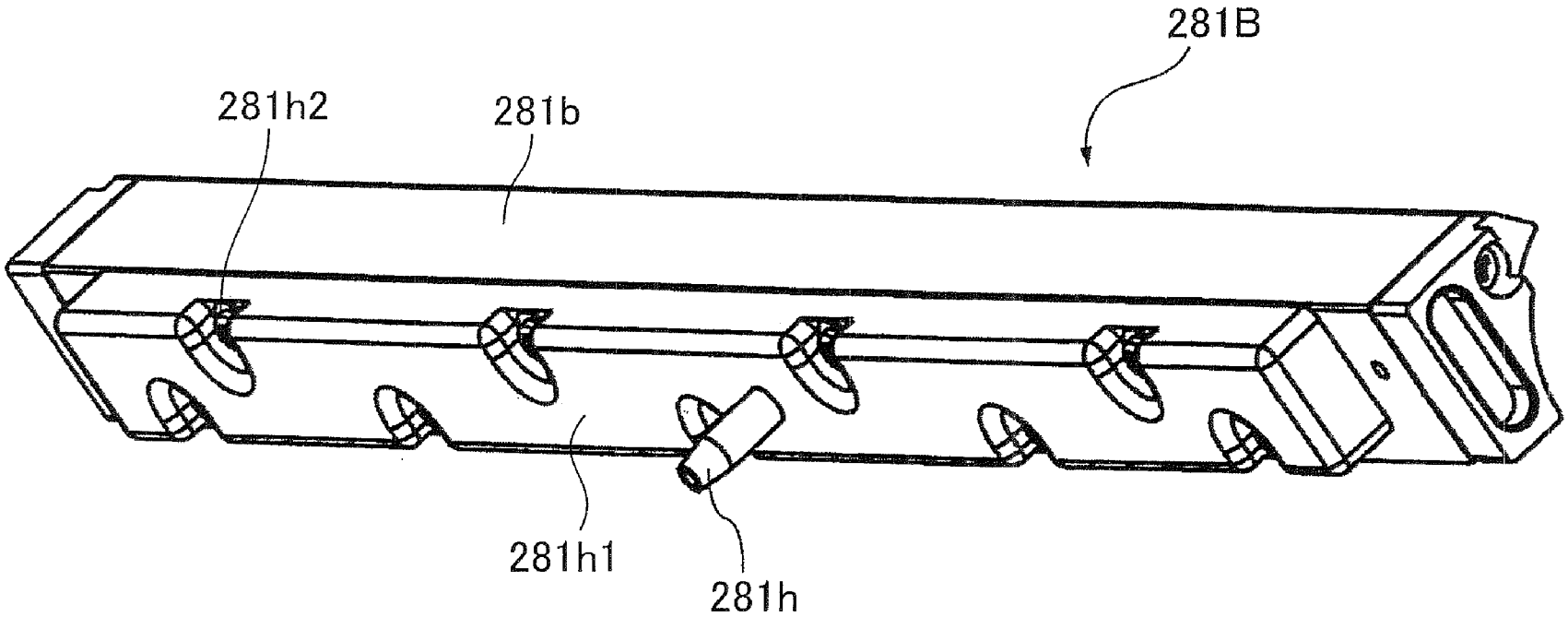
FIG. 10 is an entire perspective view of the second container when viewed from a lateral side.
Figure 11:
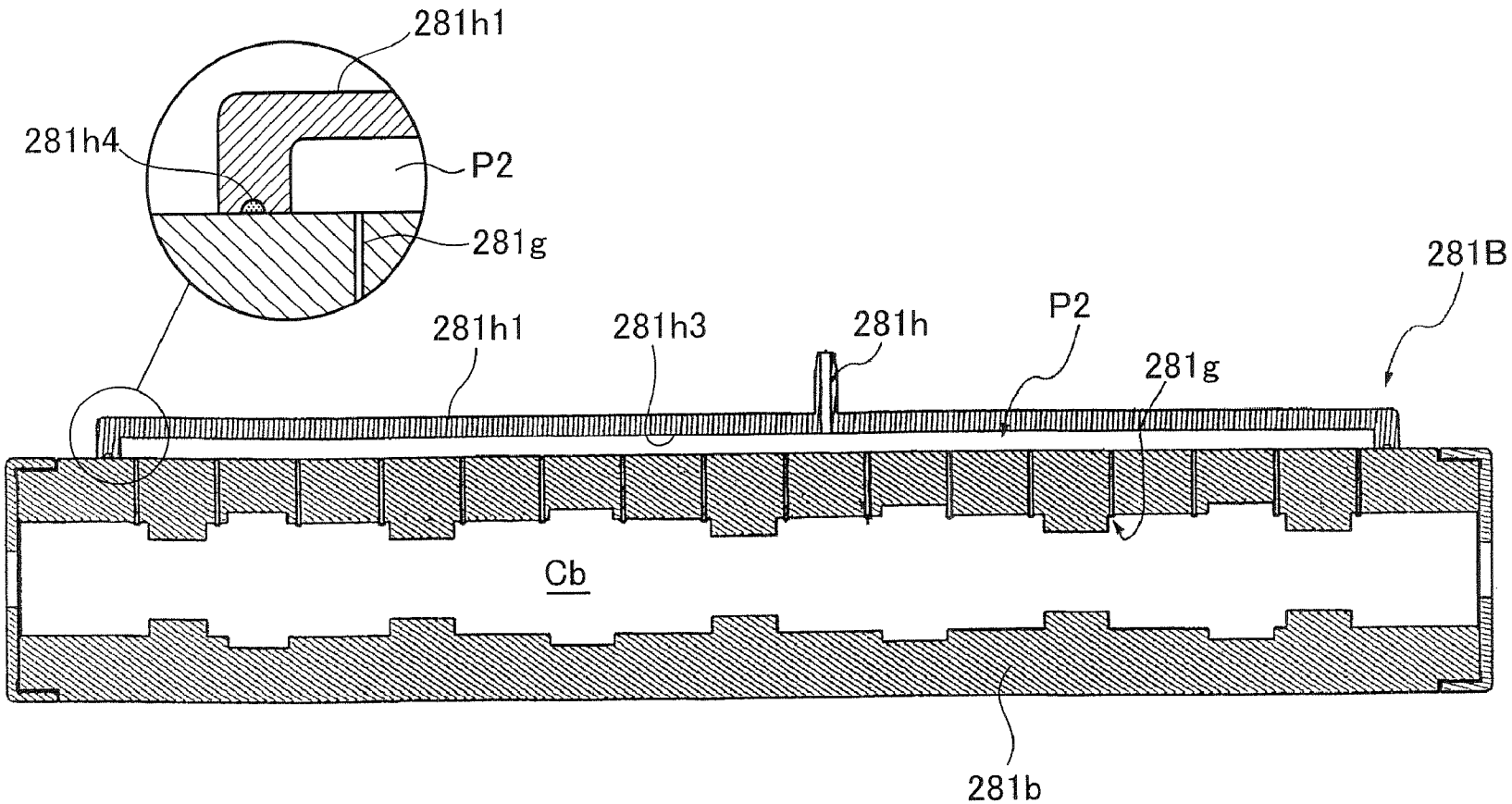
FIG. 11 is a section of the second container.

FIG. 9 is an entire perspective view of the second container 281B, FIG. 10 is an entire perspective view of the second container 281B when viewed from a lateral side, and FIG. 11 is a section of the second container 281B. The second container 281B is a member rectangular in top view and having a cavity Cb having an arcuate cross section and capable of accommodating substantially one fourth of the outer circumferential surface of the electrode roller 282 at the upper side. The spacing between the surface of this cavity Cb and the outer circumferential surface of the electrode roller 282 is kept at a specified distance (e.g. 0.5 mm). The first and second containers 281A, 281B are detachably attachable, and about 75% of the outer circumferential surface of the electrode roller 282 can be covered with these two containers 281A, 281B connected.

The second container 281B includes a container main body 281*b* formed with the cavity Cb, a plurality of second discharge ports 281*g* perforated in the container main body 281*b* in a row along the longitudinal direction of the cavity Cb, and a collective discharge port 281*h* communicating with the second discharge ports 281*g*.

The second discharge ports 281*g* are holes located near contact parts of the electrode roller 282 and the separation roller 283 as shown in FIG. 4 and horizontally penetrating from the inner circumferential wall of the cavity Cb to the outer surface of the container main body 281*b*. The second discharge ports 281*g* are not always necessary, but are provided to discharge the carrier liquid remaining near the contact position with the electrode roller 282 and the separation roller 283 in order to efficiently take the carrier liquid out from the liquid developer separator 28 without taking time.

Even without providing the second discharge ports 281*g*, the carrier liquid remaining near the contact position with the electrode roller 282 and the separation roller 283 flows down in the liquid storage container 281 as time passes, and is discharged through the first discharge port 281*c*.

The collective discharge port 281*h* is a discharge hole for collectively discharging the carrier liquid discharged from the respective second discharge ports 281*g* to the outside of the liquid storage container 281. The collective discharge port 281*h* is formed in a second cover member 281*h*1 mounted on a side wall of the container main body 281*b* by screws 281*h*2. As shown in FIG. 11, the second cover member 281*h* is a member having a shallow recess 281*h*3 to form a second liquid conveyance passage P2 communicating with the respective second discharge ports 281*g*. The collective discharge port 281*h* is formed to penetrate the bottom surface of this recess 281*h*3. A side of the second cover member 281*h*1 where the recess 281*h*3 is formed is held in contact with the side wall of the container main body 281*b*, and a sealing member 281*h*4 is provided at the opening edge of the recess 281*h*3 to prevent liquid leakage as enlargedly shown in a circle of FIG. 11. By mounting such a second cover member 281*h*1, the plurality of second discharge ports 281*g*, the second liquid conveyance passage P2 and the collective discharge port 281*h* communicate to form a manifold supply passage for the carrier liquid.

The first discharge port 281*c* (tubular member 281*c*0) and the collective discharge port 281*h* are connected with one end of the tenth pipe 882 (see FIG. 3). The separated and extracted carrier liquid is introduced to the carrier tank 274 via the tenth pipe 882. At this time, the toner density in the carrier liquid is confirmed by the toner density measuring device 291 to be described later.

The sealing member 280*j* is a member made of cell polymer for preventing the liquid developer from leaking to the outside from joined surfaces 280*m*, 280*n* where the first and second containers 280A, 280B are attached and detached. The sealing member 280*j* is interposed between the joined surface 280*m* of the first container 280A and the joined surface 280*n* of the second container 280B, bonded to the first container 280A and arranged in an elastically deformed state.

Figure 12:
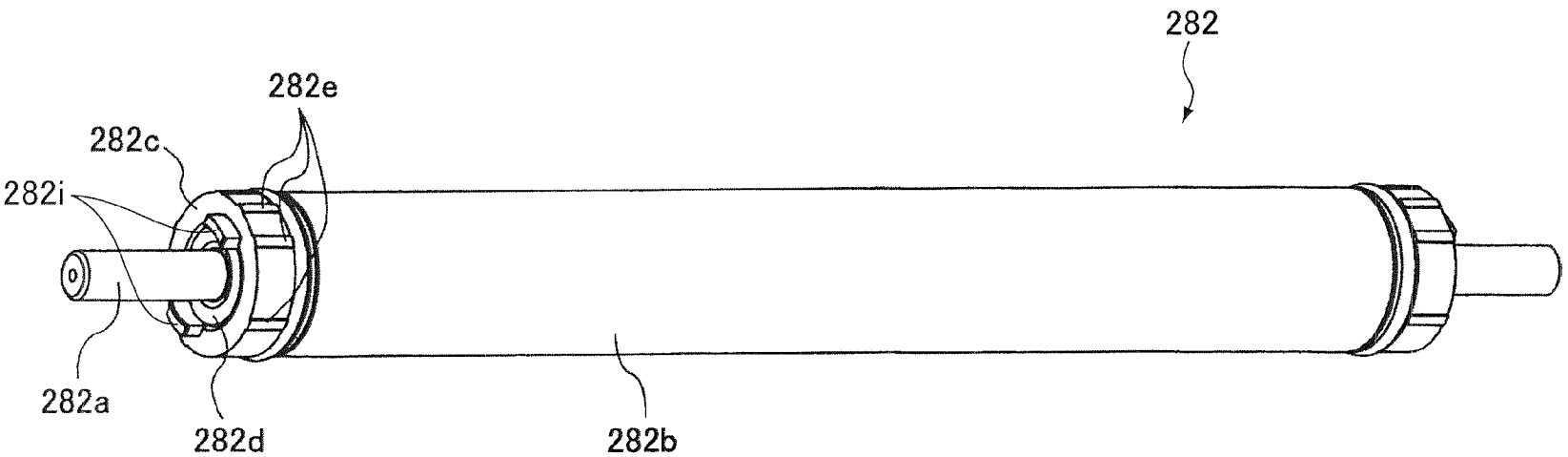
FIG. 12 is a perspective view of an electrode roller.
Figure 13:
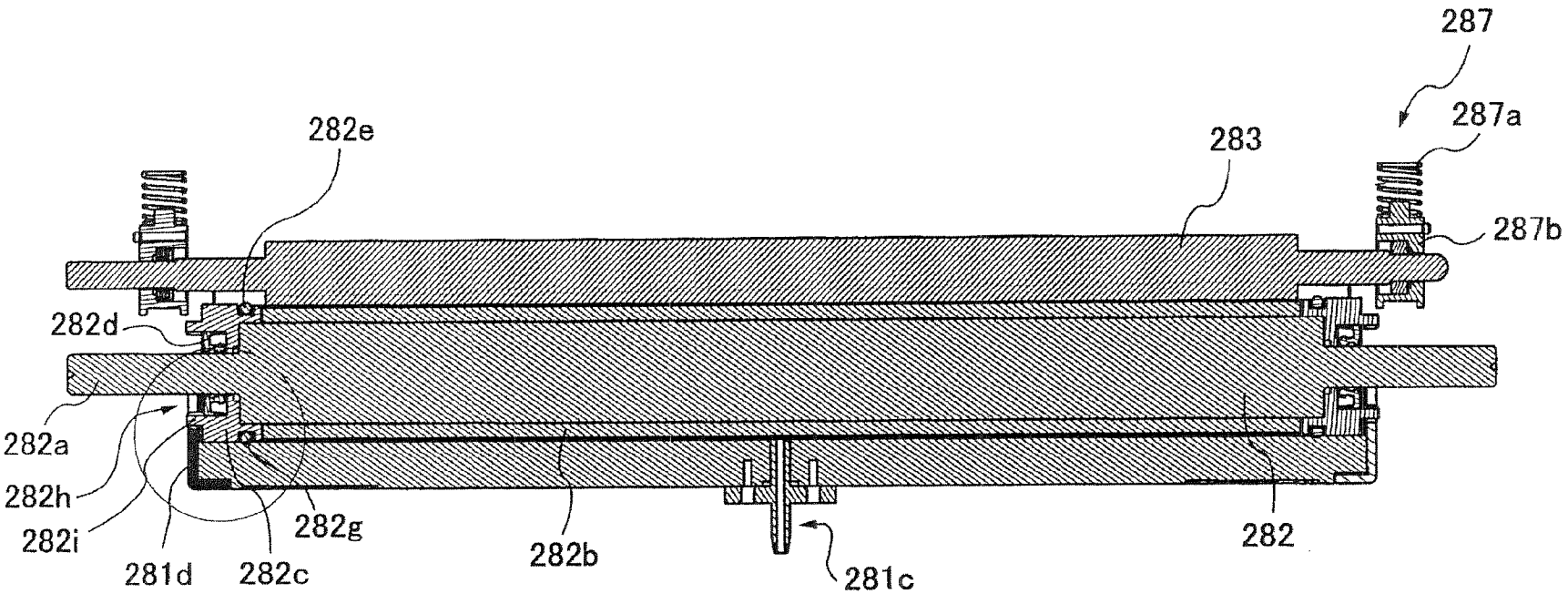
FIG. 13 is a longitudinal section of the liquid developer separator.
Figure 14:
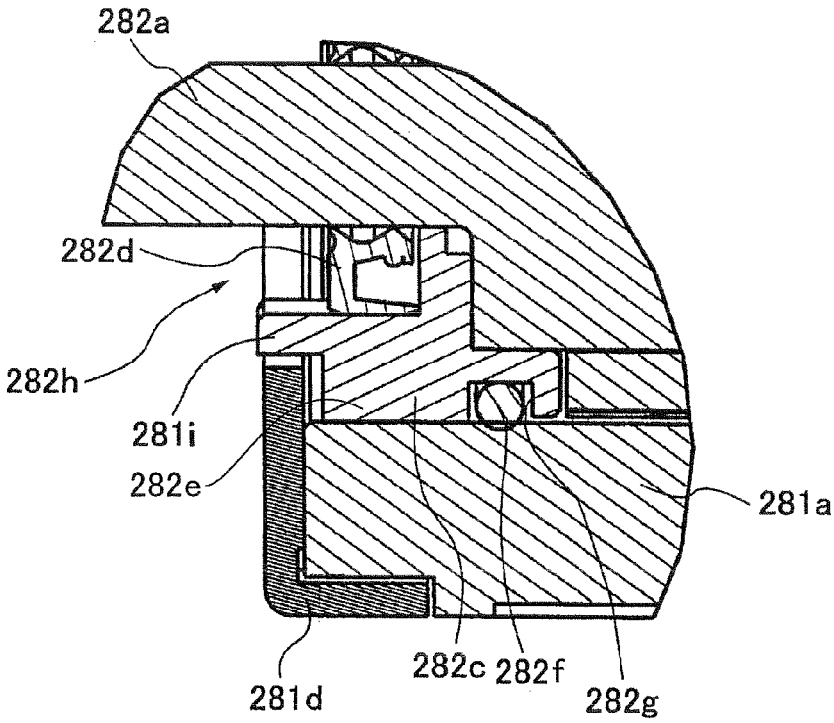
FIG. 14 is a partial enlarged view of FIG. 13.
Figure 15:
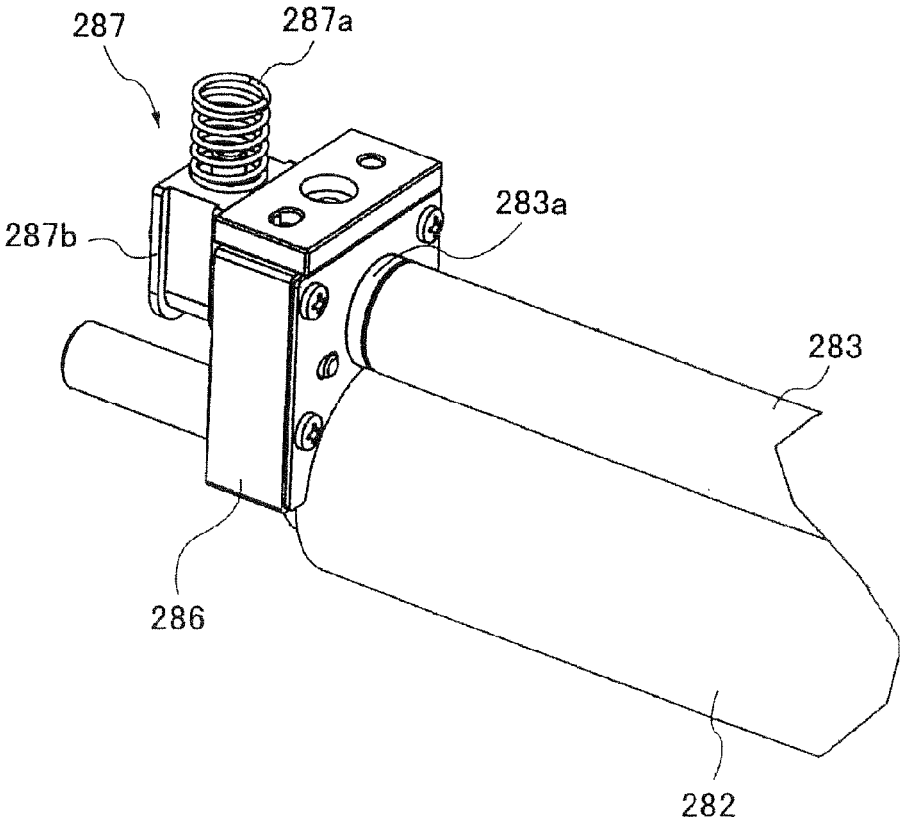
FIG. 15 is a perspective view showing the electrode roller and a separation roller at one end side.

Next, the electrode roller 282 and the separation roller 283 are described. FIG. 12 is a perspective view of the electrode roller 282, FIG. 13 is a longitudinal section of the liquid developer separator 28, FIG. 14 is a partial enlarged view of an encircled part of FIG. 13, and FIG. 15 is a perspective view showing the electrode roller 282 and the separation roller 283 at one end side.

The electrode roller 282 is a roller member made of metal (specifically made of SUS) and connected to the voltage supply 285 to have a voltage applied thereto. The electrode roller 282 also functions as a position reference for other members (liquid storage container 281, separation roller 283). The electrode roller 282 includes the rotary shaft 282*a*, a pipe-shaped roller portion 282*b* integrally and concentrically rotating with the rotary shaft 282*a*, shaft supporting members 282*c* (annular members), seal packings 282*d* and liquid leakage preventing members 282*f*.

A rotational driving force (e.g. about 5 rpm) is given to the rotary shaft 282*a* by an unillustrated driver. The roller portion 282*b* is a part fitted on the rotary shaft 282*a* to face the cavities C, Cb of the liquid storage container 281. For example, if the printer 1 deals with a maximum size of A3 sheets, a roller having a diameter of about 40 mm, a longitudinal length of about 320 mm and a surface roughness Ry of about 6.3 can be adopted as the roller portion 282*b*.

The shaft supporting members 282*c* are annular members for specifying the positional relationship of the electrode roller 282 and the first and second containers 281A, 281B by holding the cavity C of the first container 281A and the cavity Cb of the second container 281B in contact with projections 282*e* to be described later, and are arranged at the opposite longitudinal ends of the roller portion 282*b* in a state that the shaft supporting members 282*c* come into contact with the longitudinal ends of the roller portion 282*b*. The diameter of the shaft supporting member 282*c* is identical with the diameter of the roller portion 282*b* of the electrode roller 282. Each shaft supporting member 282*c* includes a plurality of projections 282*e*, a pair of projecting pieces 282*i*, an annular groove 282*g* and a recess 282*h*.

Six projections 282*e* are formed at equal intervals on the outer circumferential surface of the shaft supporting member 282*c*. These projections 282*e* are held in contact with the wall surfaces of the cavities C, Cb of the liquid storage container 281 and function to position the liquid storage container 281 relative to the electrode roller 282 by being held in contact with the liquid storage container 281 (see FIG. 4).

The height of the projections 282*e* defines the spacing between the inner wall surfaces of the cavities C, Cb and the outer circumferential surface of the electrode roller 282. For example, the above spacing can be set to 0.5 mm by setting the height of the projections 282*e* to 0.5 mm. This spacing needs not to be constant and may vary within such a range as to satisfy conditions of, e.g. not causing the leakage due to the applied voltage and satisfying a predetermined separation efficiency of the liquid developer. For example, the spacing corresponding to the bottommost part of the electrode roller 282 may be 0.5 mm and the spacing at the topmost part of the electrode roller 282 facing the second container 281B may be 0.3 mm.

The pair of projecting pieces 282*i* is formed to project outward from each shaft supporting member 282*c* in longitudinal direction. The projecting pieces 282*i* are inserted into the unillustrated stationary bearings for rotatably supporting the rotary shaft 282*a* of the electrode roller 282. By such insertion, the shaft supporting members 282*c* are fixedly retained. Thus, the positions of the projections 282*e* shown in FIG. 4 are fixed to keep the spacing between the inner wall surfaces of the cavities C, Cb of the liquid storage container 281 and the outer circumferential surface of the electrode roller 282 constant.

The annular grooves 282*g* are grooves formed by recessing the outer circumferential surface of the shaft supporting members 282*c*. The liquid leakage preventing members 282*f* are accommodated in the annular grooves 282*g*. The liquid leakage preventing members 282*f* are members for preventing the leakage of the liquid developer from the liquid storage container 281 and arranged near the opposite ends of the roller portion 282*b*. The recesses 282*h* are annularly formed in the end surfaces of the shaft supporting members 282*c* not facing the roller portion 282*b* and adapted to accommodate the seal packings 282*d*.

The seal packings 282*d* are arranged on the outer circumferential surface of the rotary shaft 282*a* to prevent the liquid developer from moving outward along the rotary shaft 282*a*.

The separation roller 283 is an electrically conductive roller arranged in contact with the electrode roller 282 for separating the carrier liquid from the liquid developer being conveyed along the outer circumferential surface of the electrode roller 282. The separation roller 283 has the outer circumferential surface thereof made of an elastic material and is elastically deformed by being biased toward the electrode roller 282 by the biasing mechanisms 287 (see FIGS. 13 and 14).

For example, a roller formed by cladding the outer surface of a SUS pipe with urethane rubber having an electrical conduction process applied thereto can be used as the separation roller 283. In order to conform to the above exemplified electrode roller 282, the separation roller 283 may be, for example, dimensioned such that the diameter thereof is about 20 mm, the longitudinal length thereof is about 310 mm and a nip depth with the electrode roller 282 is about 0.5 mm. As shown by arrows in FIG. 4, the separation roller 283 is rotated in a direction opposite to the rotating direction of the electrode roller 282 (the moving direction of the outer circumferential surface of the separation roller 283 in the nip portion is the same as the electrode roller 282), and the rotating speed thereof is about 10 rpm.

If the separation roller 283 and the electrode roller 282 are dimensioned as described above, the processed volume of the liquid developer per one batch is 5 g (4.3 g of the carrier liquid and 0.7 g of the toner particles), and about 3.7 g of the carrier liquid can be extracted by an one batch process of about 75 seconds.

Pulleys 283*a* rotatable relative to the separation roller 283 are arranged at the both longitudinal ends of the separation roller 283 (see FIG. 15).

Referring back to FIGS. 4 and 5, the blade member 284 as the collecting member is for collecting the toner particles from the outer circumferential surface of the electrode roller 282. The blade member 284 is arranged downstream of the nip portion of the electrode roller 282 and the separation roller 283 in the rotating direction of the electrode roller 282 and upstream of the supply port 281*f* provided at the first container 281A in the rotating direction of the electrode roller 282. The blade member 284 is a plate-like member extending along the rotary axis of the electrode roller 282.

As shown in FIG. 3, the voltage supply 285 is electrically connected with the liquid storage container 281, the electrode roller 282 and the separation roller 283 so as to be able to apply voltages to the respective members. The voltage supply 285 applies a voltage of −500 V and a voltage of +500 V respectively to the electrode roller 282 and to the separation roller 283 so that an electric field for moving the positively charged toner particles from the separation roller 283 to the electrode roller 282 is generated between the electrode roller 282 and the separation roller 283. The voltage supply 285 also applies a voltage of +500 V to the liquid storage container 281 so that an electric field for moving the toner particles from the liquid storage container 281 to the electrode roller 282 is generated between the electrode roller 282 and the liquid storage container 281.

The liquid motion preventing portions 286 are members arranged at the both longitudinal ends of the separation roller 283 and the electrode roller 282 as shown in FIG. 15. Each liquid motion preventing portion 286 has a round hole capable of accommodating the separation roller 283 and an arcuate part having the same curvature as that of the electrode roller 282.

The biasing mechanisms 287 are for biasing the separation roller 283 toward the electrode roller 282. Each biasing mechanism 287 includes a coil spring 287*a* having one end fixed to an unillustrated outer frame, and a roller shaft supporting member 287*b* disposed at the other end of the coil spring 287*a* and capable of supporting the shaft of the separation roller 283. The shaft of the separation roller 283 is biased by the coil springs 287*a* via the roller shaft supporting members 287*b*, whereby the outer circumferential surface of the separation roller 283 is pressed against that of the electrode roller 282. A force given by the coil springs 287*a* to press the separation roller 283 is, for example, 2 kg.

Figure 16:
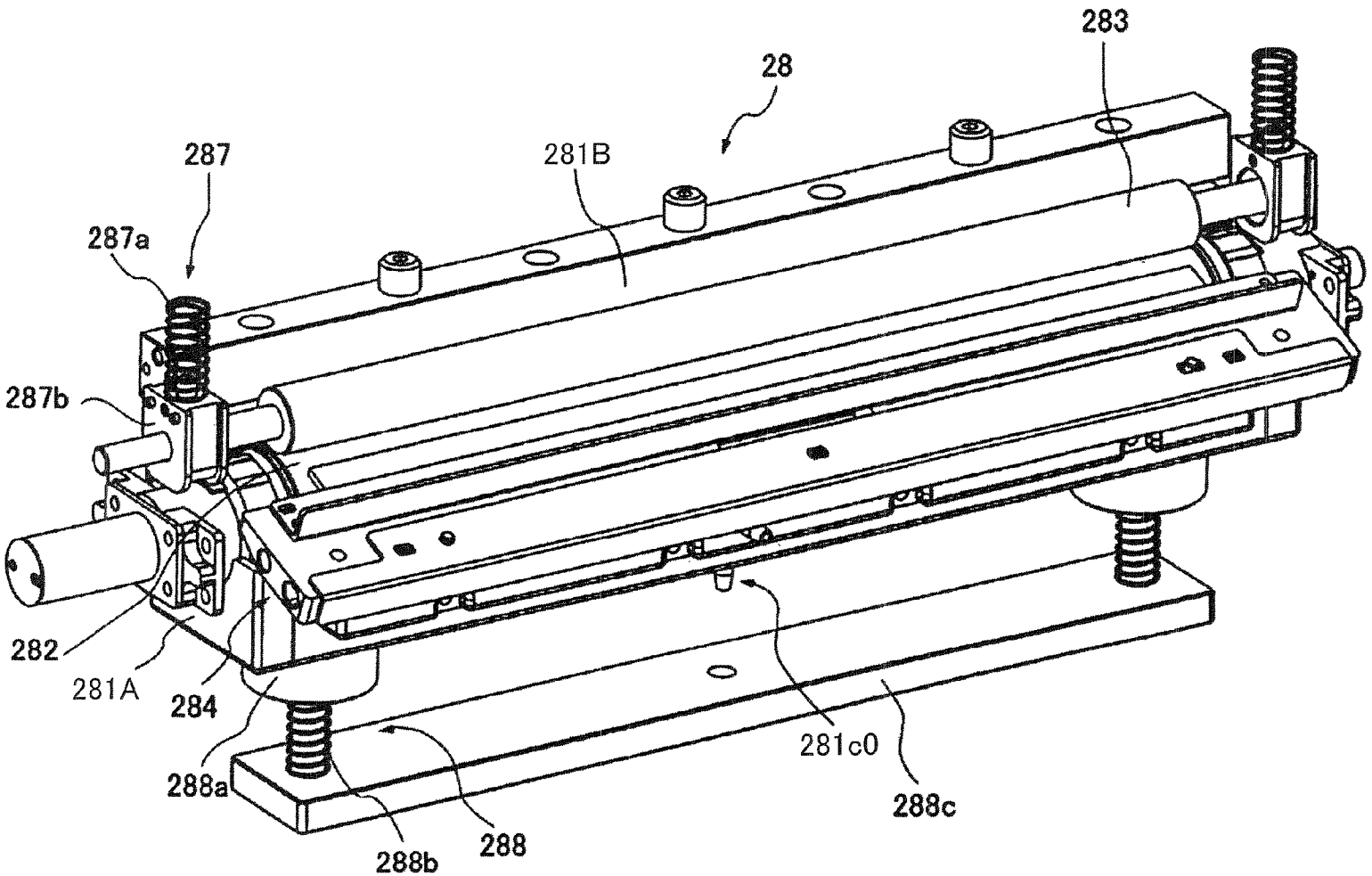
FIG. 16 is an entire perspective view of the liquid developer separator.

The first container biasing mechanism 288 is for biasing the first container 281A toward a side where the electrode roller 282 is arranged, i.e. toward the upper side of FIG. 4 as shown in FIGS. 4 and 16, and is arranged below the first container 281A. The first container biasing mechanism 288 includes first contact members 288*a*, second coil springs 288*b* and a spring supporting member 288*c*.

The first contact members 288*a* are parts to be held in contact with the bottom surface of the first container 281A, and provided near the opposite longitudinal ends of the first container 281A. The first contact members 288*a* are disk-shaped parts and connected with the upper ends of the second coil springs 288*b*. The second coil springs 288*b* are for biasing the first contact members 288*a* toward the electrode roller 282, and the bottom ends thereof are connected with the spring supporting member 288*c*.

The second container biasing mechanism 289 is for biasing the second container 281B toward the first container 281A, i.e. toward the lower side of FIG. 4, and is arranged above the second container 281B. The second container biasing mechanism 289 includes a second contact part 289*a* to be held in contact with the second container 281B and a biasing member (not shown) for biasing the second contact part 289*a*.

By providing the first container biasing mechanism 288 and the second container biasing mechanism 289, connection strength between the first and second containers 281A, 281B can be increased and the leakage of the liquid developer through a connected portion of the first and second containers 281A, 281B can be made more difficult. It should be noted that either the first container biasing mechanism 288 or the second container biasing mechanism 289 may be omitted.

The toner collection container 290 is for storing the toner particles collected by the blade member 284. Although not shown in detail in FIG. 3, a mechanism is provided which collects the toner particles scraped off by the blade member 284 into a receiving container by means of a sweep roller and conveys the collected toner particles to the toner collection container 290 by means of a conveyance screw disposed in the receiving container.

The toner density measuring device 291 is for making a measurement to judge whether or not the density of toner particles in the carrier liquid separated and extracted by the liquid developer separator 28 is equal to or below a predetermined value. It is not desirable to supply the carrier liquid having a toner density above the predetermined value to the carrier tank 274. Accordingly, the carrier liquid discharged from the liquid developer separator 28 is taken out, the density of toner particles in the carrier liquid is measured by the toner density measuring device 291, and the carrier liquid is fed to the carrier tank 274 after it is confirmed that the toner density is equal to or below the predetermined value. In order to implement such a system, a construction in which a feedback piping system 2912 is provided by mounting three-way valves 2911 in the ninth pipe 881 and the tenth pipe 882 and the eleventh pump P11 and the toner density measuring device 291 are incorporated into the feedback piping system 2912 is shown as an example in FIG. 3.

The controller 90 includes a CPU (Central Processing Unit) for performing an arithmetic processing, a ROM (Read Only Memory) storing various control programs and the like, a RAM (Random Access Memory) for temporarily saving data obtained by the arithmetic processing and control processing and other data. The controller 90 controls the driving of the first to eleventh pumps P1 to P11, the motor for actuating the liquid level detecting member 276*a*, and the like.

3. Operations

First, the image forming operation of the color printer 1 is described. The color printer 1 having received an image forming instruction from a personal computer (not shown) connected with the color printer 1 forms toner images of the respective colors corresponding to an image data given with the instruction to form an image using the image forming units FM, FC, FY and FB. Specifically, electrostatic latent images based on the image data are formed on the photoconductive drums 10, and the toner particles are supplied to these electrostatic latent images from the developing devices 14. The respective images formed in the image forming units FY, FM, FC and FB in this way are transferred to the intermediate transfer belt 21 and become a color toner image by being superimposed on the intermediate transfer belt 21.

In synchronism with the formation of this color toner image, one sheet accommodated in the sheet cassette 31 of the sheet accommodating section 3 is picked out from the sheet cassette 31 by the feed roller 32 and fed to the sheet conveying assembly 6 by the pair of separation rollers 33. The sheet is fed to the pair of registration rollers 62 by the pair of conveyance rollers 61 of the sheet conveying assembly 6, and the conveyance thereof is temporarily stopped while the conveying posture thereof is corrected by the pair of registration rollers 62. The sheet is fed to the secondary transfer device 4 while being timed with the primary transfer to the intermediate transfer belt 21, and the color toner image on the intermediate transfer belt 21 is secondarily transferred to the sheet in the secondary transfer device 4.

The sheet having the color toner image transferred thereto is conveyed to the fixing device 5 to be heated and pressed, whereby this color toner image is fixed to the sheet. The sheet having the color toner image fixed thereto is further conveyed to the discharging device 7 and discharged to the discharge tray 72 provided outside the color printer 1 by the pair of discharge rollers 71. After the secondary transfer, the liquid developer residual on the intermediate transfer belt 21 is removed therefrom by the cleaning roller 22*a* and the cleaning blade 22*b* of the cleaner 22 for the intermediate transfer belt 21.

Next, an operation of supplying the liquid developer to the developing device 14, i.e. an operation of circulating the liquid developer is described.

The liquid developer residual on the development roller 141 without being supplied to the photoconductive drum 10 during the image forming operation is scrapped off by the development roller cleaning blade 145, and collected into the residual developer tank 271 via the first pipe 81. The liquid developer collected into the developer container 140 without being supplied from the supply roller 142 to the development roller 141 is also collected into the residual developer tank 271 via the second pipe 82. Further, the carrier liquid extracted in the liquid developer separator 28 from the residual developer collected in the cleaning device 26 is collected into the carrier tank 274. The driving of the first, fifth, ninth and tenth pumps P1, P5, P9 and P10 is controlled by the controller 90 for such liquid circulation.

When the liquid developer in the developer adjusting device 272 is used up, the controller 90 causes the second pump P2 to be driven, whereby the residual developer is supplied from the residual developer tank 271 to the developer adjusting device 272. When the developer adjusting device 272 is filled with the residual developer, the toner density of the residual liquid developer is detected by the solid content density detector 273. Based on this detection result, the controller 90 causes the third pump P3 or the eighth pump P8 to be driven to supply a necessary amount of the carrier liquid or the high density liquid developer to the developer adjusting device 272. Thereafter, the toner density of the liquid developer is detected by the solid content density detector 273 again. If the toner density lies within the proper range, the liquid developer is supplied to the developer reserve tank 277 if necessary.

Figure 17:
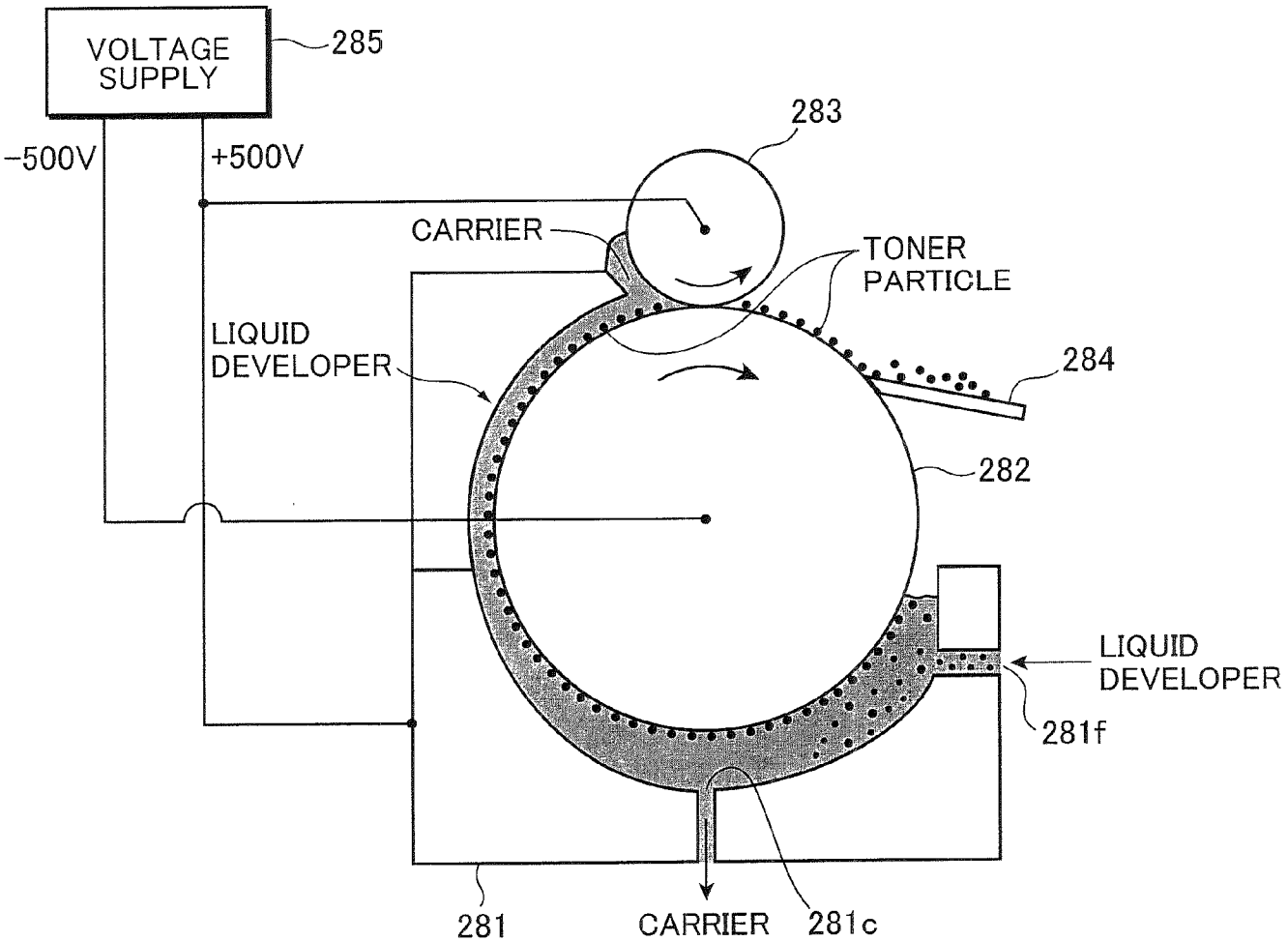
FIG. 17 is a diagram showing the function of the liquid developer separator.

Next, the operation of the liquid developer separator 28 is described with reference to FIG. 17. FIG. 17 is a diagram showing the function of the liquid developer separator 28. As described above, the toner particles are positively charged. The voltage supply 285 applies a negative voltage (e.g. −500 V) to the electrode roller 282 and positive voltages (e.g. +500 V) to the liquid storage container 281 and the separation roller 283.

Specifically, the voltage having the same polarity as the toner particles is applied to the liquid storage container 281 and the separation roller 283, and the voltage having a polarity opposite to that of the toner particles is applied to the electrode roller 282. As a result, out of the liquid developer stored in the liquid storage container 281, the toner particles move toward the electrode roller 282 and the carrier liquid having no electric charges remains in the liquid storage container 281.

Accordingly, if the liquid developer is introduced into the liquid storage container 281 through the supply port 281*f*, the toner particles in the liquid developer move toward the electrode roller 282 and are attached to the outer circumferential surface of the electrode roller 282 upon receiving an electrical attraction force. On the other hand, the carrier liquid having no electric charges receives no electrical attraction force and exists in a fluid state between the electrode roller 282 and the liquid storage container 281 until the measurement result of the toner density by the toner density measuring device 291 falls to or below the predetermined value. After the measurement result of the toner density is confirmed to be equal to or below the predetermined value, the carrier liquid is discharged through the first discharge port 281*c* (and second discharge ports 281*g*).

The liquid developer is conveyed to the nip portion between the electrode roller 282 and the separation roller 283 as the electrode roller 282 is rotated. The toner particles electrically attracted to the electrode roller 282 are electrically biased in a direction away from the separation roller 283, i.e. toward the electrode roller 282, from the separation roller 283 in the nip portion. On the contrary, the carrier liquid remains in the nip portion without receiving any electrical biasing force. Thus, only the toner particles adhering to the electrode roller 282 pass between the electrode roller 282 and the separation roller 283.

The toner particles adhering to the electrode roller 282 are scraped off by the blade member 284. The scraped-off toner particles are collected into the toner collection container 290 (see FIG. 3).

The carrier liquid is collected into the carrier tank 274. Before that, it is confirmed whether or not the toner density in the carrier liquid is same or below the predetermined value. Thus, the carrier liquid discharged through the first discharge port 281*c* and the second discharge ports 281*g* is first fed to the toner density measuring device 291 via the feedback piping system 2912 without being immediately fed to the carrier tank 274.

If the density of the toner particles remaining in the separated and extracted carrier liquid is confirmed to have fallen to or below the predetermined value by the toner density measuring device 291, the flow path of the downstream three-way valve 2911 is switched and the carrier liquid is conveyed to the carrier tank 274 by driving the tenth pump P10. On the other hand, if the density of the residual toner particles exceeds the predetermined value, the liquid developer continues to be fed back to the liquid storage container 281 without switching the flow path of the downstream three-way valve 2911.

According to such a liquid developer separator 28, time, labor and cost for maintenance can be saved since the liquid developer can be separated and extracted by the electrode roller 282 and the separation roller 283.

Further, since the projections 282*e* formed on the outer circumferential surfaces of the shaft supporting members 282*c* are held in contact with the cavity wall surfaces of the liquid storage container 281, the spacing between the electrode roller 282 and the liquid storage container 281 can be kept constant. Furthermore, since the outer circumferential surfaces of the supporting shaft members 282*c* are not entirely held in contact with the cavity wall surfaces of the liquid storage container 281, the shaft supporting members 282*c* are unlikely to adhere to the cavity wall surfaces and the liquid storage container 281 can be easily detached from the electrode roller 282 at the time of maintenance and the like. Further, the outward leakage of the liquid developer along the longitudinal direction of the rotary shaft 282*a* of the electrode roller 282 can be prevented by the liquid leakage preventing members 282*g* and the seal packings 282*d*.

Here, at the time of maintenance and the like, the first and second containers 281A, 281B are detached by canceling the biasing by the first container biasing mechanism 288 and the second container biasing mechanism 289. In this embodiment, since the liquid storage container 281 is so constructed as to be divided into the first and second containers 281A, 281B, it is easily detachable from the electrode roller 282 upon the maintenance of the electrode roller 282 despite such a construction that the spacing between the electrode roller 282 and the liquid storage container 281 is as small as 0.5 mm and the liquid storage container 281 covers most of the electrode roller 282. Further, the liquid storage container 281 is easily mountable on the electrode roller 282. Furthermore, since the sealing member 280*j* is arranged between the first and second containers 281A, 281B, the leakage of the liquid developer from the inside to the outside of the liquid storage container 281 can be prevented.

4. Other Embodiments (a) In the above embodiment, the blade member 284 is illustrated as the collecting member. Besides, any other member such as a cleaning roller or a cleaning brush can also be adopted provided that it can remove the toner particles adhering to the electrode roller 282.

(b) In the above embodiment, the liquid sample to be processed is the liquid developer, wherein the dispersoid is the toner particles and the dispersion medium is the carrier liquid. The present invention is not limited thereto, and the liquid developer may contain other substances as the dispersoid and the dispersion medium, e.g. pigment as the dispersoid and moisture as the dispersion medium.

(c) In the above embodiment, the projections 282*e* are provided on the outer circumferential surfaces of the shaft supporting members 282*c*. The present invention is not limited to this, and projecting portions may be provided at positions of the wall surfaces of the cavities C, Cb of the liquid storage container 281 corresponding to the annular members 282*c*.

(d) Although the cell polymer is used as the sealing member 280*j* in the above embodiment, the present invention is not limited to this and another substance such as rubber may be used.

The specific embodiment described above mainly embraces inventions having the following constructions.

A liquid separator according to one aspect of the present invention is for separating and extracting a dispersoid and a dispersion medium from a liquid sample containing the dispersoid and the dispersion medium and comprises a liquid storage container capable of storing the liquid sample; an electrode roller including a rotary shaft, arranged to touch the liquid sample in the liquid storage container, capable of conveying the liquid sample along the outer circumferential surface thereof and rotatable about the rotary shaft; and a separating member held in contact with the electrode roller for separating the dispersion medium from the liquid sample being conveyed along the outer circumferential surface of the electrode roller, wherein the liquid storage container includes a first container positioned at a specified distance to the electrode roller and a second container detachably attachable to the first container.

According to this construction, the liquid sample containing the dispersoid and the dispersion medium is stored in the liquid storage container. At this time, as the electrode roller rotates, the liquid sample is conveyed to the contact position with the electrode roller and the separating member to separate the dispersion medium by the separating member. According to such a liquid separator, since the liquid sample can be separated and extracted by the electrode roller and the separating member, maintenance time and labor such as the replacement of a continuous foam material can be eliminated and cost necessary for maintenance can be reduced. Since the liquid storage container is comprised of the first and second containers and the second container is detachably attachable to the first container, the liquid storage container is easily detachable from the electrode roller. Therefore, there are advantages of facilitating the maintenance of the electrode roller, the cleaning of the liquid storage container and the like.

In the above construction, it is preferable to further comprise a collecting member at a position downstream of the contact position with the electrode roller and the separating member in a rotating direction of the electrode roller for collecting the dispersoid from the outer circumferential surface of the electrode roller. According to this construction, the dispersoid can be reliably collected.

In the above construction, the liquid storage container preferably has a cavity corresponding to the outer circumferential surface of the electrode roller and covers more than half the outer circumferential surface of the electrode roller. According to this construction, an area of a part of the liquid storage container facing the electrode roller increases to make it easier to separate the dispersoid and the dispersion medium from the liquid sample.

In this case, it is preferable that the first container has a semicylindrical cavity capable of accommodating substantially half the outer circumferential surface of the electrode roller; and that the second container has a cavity that is arcuate in a section and capable of accommodating substantially one fourth of the outer circumferential surface of the electrode roller.

In the above construction, it is preferable to further comprise a sealing member provided in a joining portion where the first and second containers are joined and adapted to prevent the leakage of the liquid sample from the joining portion. According to this construction, the liquid sample can be prevented from leaking out through a connecting portion of the first and second containers.

In the above construction, the first container preferably includes a first discharge port capable of discharging the dispersion medium separated from the liquid sample from the cavity. In this case, it is more preferable that the first container covers the lower side of the outer circumferential surface of the electrode roller; and that the first discharge port is arranged at the bottommost position or its vicinity of the cavity. According to this construction, the separated dispersion medium can be efficiently collected.

In the above construction, it is preferable that the second container is attached above the first container; and that the second container includes a second discharge port capable of discharging the dispersion medium. In this case, the second discharge port is more preferably arranged near a position where the electrode roller and the separating member are in contact. According to this construction, the separated dispersion medium can be collected also in the second container.

In the above construction, it is preferable to further comprise a tubular member, one end of which is inserted into the first discharge port and the other end of which projects outward of the first container. According to this construction, the liquid storage container can be easily connected with a collection system for the dispersion medium.

In the above construction, the first container preferably includes a liquid sample supply port for receiving the supply of the liquid sample into the cavity. According to this construction, the liquid sample can be supplied into the liquid storage container without being scattered.

In this case, it is preferable that the first container includes a plurality of through holes penetrating from the inner wall of the cavity to the outer wall of the first container; and that the liquid separator further comprises a first cover member formed with the liquid sample supply port, covering the plurality of through holes and attached to the outer wall of the first container.

Further, it is preferable that the second container includes a plurality of through holes penetrating from the inner wall of the cavity and the outer wall of the second container as the second discharge port; and that the liquid separator further comprises a second cover member formed with a collective discharge port, covering the plurality of through holes and attached to the outer wall of the second container.

In the above construction, it is preferable to further comprise a biasing mechanism for biasing at least one of the first and second containers toward the second or first containers. According to this construction, connection strength between the first and second containers can be increased to reliably suppress the leakage of the liquid sample from the connecting portion of the first and second containers.

In this construction, the separating member is preferably an electrically conductive and elastic roller member. According to this construction, a nip portion can be formed by the contact of this roller member with the electrode roller, which is advantageous in blocking up the dispersion medium.

In the above construction, the collecting member is preferably a blade member for scraping off the dispersoid from the outer circumferential surface of the electrode roller. According to this construction, the dispersoid can be easily and reliably scraped off.

In the above construction, it is preferable that the liquid sample is a liquid developer; that the dispersoid is toner particles; and that the dispersion medium is a carrier liquid. According to this construction, the toner particles and the carrier liquid can be separated and extracted from the liquid developer containing the toner particles and the carrier liquid. Accordingly, the liquid separator of the present invention can be applied to a wet-type image forming apparatus.

A liquid mixture supplying system according to another aspect of the present invention comprises a liquid consuming device for consuming a liquid mixture containing a dispersoid and a dispersion medium; a liquid supplying unit for supplying the liquid mixture to the liquid consuming device; a collection system for collecting the liquid mixture that has been supplied to the liquid consuming device, but has not been consumed by the liquid consuming device; and a liquid separator provided in the collection system for separating and extracting the dispersoid and the dispersion medium from the collected liquid mixture, wherein the liquid separator includes a liquid storage container capable of storing the liquid mixture; an electrode roller including a rotary shaft, arranged to touch the liquid mixture in the liquid storage container, capable of conveying the liquid mixture along the outer circumferential surface thereof and rotatable about the rotary shaft; a separating member held in contact with the electrode roller for separating the dispersion medium from the liquid mixture being conveyed along the outer circumferential surface of the electrode roller; and a collecting member for collecting the dispersoid from the outer circumferential surface of the electrode roller at a position downstream of the contact position with the electrode roller and the separating member in a rotating direction of the electrode roller, wherein the liquid storage container includes a first container positioned at a specified distance to the electrode roller and a second container detachably attachable to the first container.

According to this construction, a system can be built in which the liquid mixture that was not consumed in the liquid consuming device is collected and the dispersoid and the dispersion medium are separated and extracted from the collected liquid mixture.

An image forming apparatus according to still another aspect of the present invention comprises a photoconductive drum for bearing a toner image on the outer circumferential surface thereof; a developing device for supplying a liquid developer containing toner particles and a carrier liquid to the photoconductive drum; a developer producer for producing the liquid developer of the toner particles and the carrier liquid for supply to the developing device by adjusting the mixing ratio of the toner particles and the carrier liquid; a first supply system for supplying a developer having a higher toner density than the developer used in the developing device to the developer producer; a second supply system for supplying the carrier liquid to the developer producer; a third supply system for supplying the liquid developer produced in the developer producer to the developing device via a reserve tank; a collection system for collecting the liquid developer that has been supplied to the developing device, but has not been consumed by the developing device or the photoconductive drum, and supplying the liquid developer to the developer producer; and a liquid separator provided in the collection system for separating and extracting the toner particles and the carrier liquid from the collected liquid developer, wherein the liquid separator includes a liquid storage container capable of storing the liquid developer; an electrode roller including a rotary shaft, arranged to touch the liquid developer in the liquid storage container, capable of conveying the liquid developer along the outer circumferential surface thereof and rotatable about the rotary shaft; a separating member held in contact with the electrode roller for separating the carrier liquid from the liquid developer being conveyed along the outer circumferential surface of the electrode roller; and a collecting member for collecting the toner particles from the outer circumferential surface of the electrode roller at a position downstream of the contact position with the electrode roller and the separating member in a rotating direction of the electrode roller, wherein the liquid storage container includes a first container positioned at a specified distance to the electrode roller and a second container detachably attachable to the first container.

In this case, it is preferable that the second supply system includes a tank for storing the carrier liquid; and that the liquid separator supplies the extracted carrier liquid to the tank.

This application is based on patent application Nos. 2007-046898, 2007-048450, 2007-049317 and 2007-049318 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A liquid separator for separating and extracting a dispersoid and a dispersion medium from a liquid sample containing the dispersoid and the dispersion medium, comprising:

a liquid storage container capable of storing the liquid sample;

an electrode roller including a rotary shaft, arranged to touch the liquid sample in the liquid storage container, capable of conveying the liquid sample along the outer circumferential surface thereof and rotatable about the rotary shaft; and a separating member held in contact with the electrode roller for separating the dispersion medium from the liquid sample being conveyed along the outer circumferential surface of the electrode roller, wherein the liquid storage container includes a first container positioned at a specified distance to the electrode roller and a second container detachably attachable to the first container.

2. A liquid separator according to claim 1, further comprising a collecting member at a position downstream of the contact position with the electrode roller and the separating member in a rotating direction of the electrode roller for collecting the dispersoid from the outer circumferential surface of the electrode roller.

3. A liquid separator according to claim 1, wherein the liquid storage container has a cavity corresponding to the outer circumferential surface of the electrode roller and covers more than half of the outer circumferential surface of the electrode roller.

4. A liquid separator according to claim 3, wherein:

the first container has a semicylindrical cavity capable of accommodating substantially half the outer circumferential surface of the electrode roller; and the second container has a cavity that is arcuate in a section and capable of accommodating substantially one fourth of the outer circumferential surface of the electrode roller.

5. A liquid separator according to claim 1, further comprising a sealing member provided in a joining portion where the first and second containers are joined and adapted to prevent the leakage of the liquid sample from the joining portion.

6. A liquid separator according to claim 3, wherein the first container includes a first discharge port capable of discharging the dispersion medium separated from the liquid sample from the cavity.

7. A liquid separator according to claim 6, wherein:

the first container covers the lower side of the outer circumferential surface of the electrode roller; and the first discharge port is arranged at the bottommost position or its vicinity of the cavity.

8. A liquid separator according to claim 1, wherein:

the second container is attached above the first container; and the second container includes a second discharge port capable of discharging the dispersion medium.

9. A liquid separator according to claim 8, wherein the second discharge port is arranged near a position where the electrode roller and the separating member are in contact.

10. A liquid separator according to claim 6, further comprising a tubular member, one end of which is inserted into the first discharge port and the other end of which projects outward of the first container.

11. A liquid separator according to claim 3, wherein the first container includes a liquid sample supply port for receiving the supply of the liquid sample into the cavity.

12. A liquid separator according to claim 11, wherein:

the first container includes a plurality of through holes penetrating from the inner wall of the cavity to the outer wall of the first container, and the liquid separator further comprises a first cover member formed with the liquid sample supply port, covering the plurality of through holes and attached to the outer wall of the first container.

13. A liquid separator according to claim 8, wherein:

the second container includes a plurality of through holes penetrating from the inner wall of the cavity and the outer wall of the second container as the second discharge ports, and the liquid separator further comprises a second cover member formed with a collective discharge port, covering the plurality of through holes and attached to the outer wall of the second container.

14. A liquid separator according to claim 1, further comprising a biasing mechanism for biasing at least one of the first and second containers toward the other of the second and first containers.

15. A liquid separator according to claim 1, wherein the separating member is an electrically conductive and elastic roller member.

16. A liquid separator according to claim 2, wherein the collecting member is a blade member for scraping off the dispersoid from the outer circumferential surface of the electrode roller.

17. A liquid separator according to claim 1, wherein:

the liquid sample is a liquid developer;

the dispersoid is toner particles; and the dispersion medium is a carrier liquid.

18. A liquid mixture supplying system, comprising a liquid consuming device for consuming a liquid mixture containing a dispersoid and a dispersion medium;

a liquid supplying unit for supplying the liquid mixture to the liquid consuming device;

a collection system for collecting the liquid mixture that has been supplied to the liquid consuming device, but has not been consumed by the liquid consuming device; and a liquid separator provided in the collection system for separating and extracting the dispersoid and the dispersion medium from the collected liquid mixture, wherein the liquid separator includes:

a liquid storage container capable of storing the liquid mixture;

an electrode roller including a rotary shaft, arranged to touch the liquid mixture in the liquid storage container, capable of conveying the liquid mixture along the outer circumferential surface thereof and rotatable about the rotary shaft;

a separating member held in contact with the electrode roller for separating the dispersion medium from the liquid mixture being conveyed along the outer circumferential surface of the electrode roller; and a collecting member for collecting the dispersoid from the outer circumferential surface of the electrode roller at a position downstream of the contact position with the electrode roller and the separating member in a rotating direction of the electrode roller, wherein the liquid storage container includes a first container positioned at a specified distance to the electrode roller and a second container detachably attachable to the first container.

19. An image forming apparatus, comprising:

a photoconductive drum for bearing a toner image on the outer circumferential surface thereof;

a developing device for supplying a liquid developer containing toner particles and a carrier liquid to the photoconductive drum;

a developer producer for producing the liquid developer of the toner particles and the carrier liquid for supply to the developing device by adjusting the mixing ratio of the toner particles and the carrier liquid;

a first supply system for supplying to the developer producer a developer having a higher toner density than the liquid developer used in the developing device;

a second supply system for supplying the carrier liquid to the developer producer;

a third supply system for supplying the liquid developer produced in the developer producer to the developing device via a reserve tank;

a collection system for collecting the liquid developer that has been supplied to the developing device, but has not been consumed by the developing device or the photoconductive drum, and supplying the liquid developer to the developer producer; and a liquid separator provided in the collection system for separating and extracting the toner particles and the carrier liquid from the collected liquid developer, wherein the liquid separator includes:

a liquid storage container capable of storing the liquid developer;

an electrode roller including a rotary shaft, arranged to touch the liquid developer in the liquid storage container, capable of conveying the liquid developer along the outer circumferential surface thereof and rotatable about the rotary shaft;

a separating member held in contact with the electrode roller for separating the carrier liquid from the liquid developer being conveyed along the outer circumferential surface of the electrode roller; and a collecting member for collecting the toner particles from the outer circumferential surface of the electrode roller at a position downstream of the contact position with the electrode roller and the separating member in a rotating direction of the electrode roller, wherein the liquid storage container includes a first container positioned at a specified distance to the electrode roller and a second container detachably attachable to the first container.

20. An image forming apparatus according to claim 19, wherein:

the second supply system includes a tank for storing the carrier liquid; and the liquid separator supplies the extracted carrier liquid to the tank.

* * * * *